US010865352B2

(12) United States Patent
Gunther et al.

(10) Patent No.: US 10,865,352 B2
(45) Date of Patent: Dec. 15, 2020

(54) REMOVAL OF POLYNUCLEAR AROMATICS FROM SEVERELY HYDROTREATED BASE STOCKS

(71) Applicant: ExxonMobil Research and Engineering Company, Annandale, NJ (US)

(72) Inventors: William R. Gunther, Clinton, NJ (US); Kendall S. Fruchey, Humble, TX (US); Vinit Choudhary, Annandale, NJ (US); Adrienne R. Diebold, Prairieville, LA (US); Jason M. McMullan, Nazareth, PA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 16/278,311

(22) Filed: Feb. 18, 2019

(65) Prior Publication Data

US 2019/0264116 A1 Aug. 29, 2019

Related U.S. Application Data

(60) Provisional application No. 62/634,456, filed on Feb. 23, 2018.

(51) Int. Cl.
*C10G 67/04* (2006.01)
*C10G 67/06* (2006.01)
(Continued)

(52) U.S. Cl.
CPC ..... *C10G 67/0454* (2013.01); *C10G 21/003* (2013.01); *C10G 25/00* (2013.01); *C10G 25/03* (2013.01); *C10G 67/049* (2013.01); *C10G 67/0463* (2013.01); *C10G 67/0481* (2013.01); *C10G 67/06* (2013.01); *C10M 101/02* (2013.01); *C10G 2300/1077* (2013.01); *C10G 2300/1096* (2013.01);
(Continued)

(58) Field of Classification Search
CPC ..... C10G 67/0454; C10G 67/0463; C10G 67/0481; C10G 67/049; C10G 67/06; C10G 2400/10
See application file for complete search history.

(56) References Cited

U.S. PATENT DOCUMENTS 3,414,506 A 12/1968 Van Lookeren et al.
4,954,242 A 9/1990 Gruia
(Continued)

FOREIGN PATENT DOCUMENTS

CN 1718689 A 1/2006

OTHER PUBLICATIONS

The International Search Report and Written Opinion of PCT/US2019/018394 dated Apr. 23, 2019.

*Primary Examiner* — Renee Robinson
(74) *Attorney, Agent, or Firm* — Scott F. Yarnell

(57) ABSTRACT

Adsorbents for aromatic adsorption are used to improve one or more properties of base stocks derived from deasphalted oil fractions. The adsorbents can allow for removal of polynuclear aromatics from an intermediate effluent or final effluent during base stock production. Removal of polynuclear aromatics can be beneficial for improving the color of heavy neutral base stocks and/or reducing the turbidity of bright stocks.

18 Claims, 9 Drawing Sheets

(51) Int. Cl.

| | |
|---|---|
| ***C10G 21/00*** | (2006.01) |
| ***C10G 25/03*** | (2006.01) |
| ***C10G 25/00*** | (2006.01) |
| ***C10M 101/02*** | (2006.01) |
| *C10N 20/02* | (2006.01) |
| *C10N 30/02* | (2006.01) |
| *C10N 70/00* | (2006.01) |

(52) U.S. Cl.
CPC . *C10G 2300/202* (2013.01); *C10G 2300/302* (2013.01); *C10G 2400/10* (2013.01); *C10N 2020/02* (2013.01); *C10N 2030/02* (2013.01); *C10N 2070/00* (2013.01)

(56) References Cited

U.S. PATENT DOCUMENTS

| | | | | |
|---|---|---|---|---|
| 4,977,871 | A | 12/1990 | Brownawell et al. | |
| 5,190,633 | A | 3/1993 | Fetzer et al. | |
| 5,358,627 | A | 10/1994 | Mears et al. | |
| 5,554,307 | A | 9/1996 | Dagorn et al. | |
| 7,776,206 | B2 | 8/2010 | Miller et al. | |
| 2013/0081977 | A1* | 4/2013 | Woo | C10G 47/02 208/95 |
| 2013/0105359 | A1* | 5/2013 | Noh | B01J 29/12 208/57 |
| 2016/0194566 | A1 | 7/2016 | Hoo et al. | |

* cited by examiner

REMOVAL OF POLYNUCLEAR AROMATICS FROM SEVERELY HYDROTREATED BASE STOCKS

CROSS-REFERENCE TO RELATED APPLICATIONS

This application claims the benefit of U.S. Provisional Application No. 62/634,456, filed on Feb. 23, 2018, the entire contents of which are incorporated herein by reference.

FIELD

Systems and methods are provided for production of lubricant oil base stocks from deasphalted oils produced by low severity deasphalting of resid fractions, and removal of heavy polynuclear aromatics. Corresponding base stocks produced using these systems and/or methods having reduced heavy polynuclear aromatics are also provided.

BACKGROUND

Lubricant base stocks are one of the higher value products that can be generated from a crude oil or crude oil fraction. The ability to generate lubricant base stocks of a desired quality is often constrained by the availability of a suitable feedstock. For example, most conventional processes for lubricant base stock production involve starting with a crude fraction that has not been previously processed under severe conditions, such as a virgin gas oil fraction from a crude with moderate to low levels of initial sulfur content.

Some limited uses of deasphalted oil formed by solvent deasphalting of a vacuum resid being as a feed for production of base stocks have previously been described. For example, deasphalted oils formed by propane desaphalting of a vacuum resid have be used for additional lubricant base stock production. However, the severity of propane deasphalting required in order to make a suitable feed for lubricant base stock production typically results in a yield of only about 30 wt % deasphalted oil relative to the vacuum resid feed.

As another example, U.S. Pat. No. 3,414,506 describes methods for making lubricating oils by hydrotreating pentane-alcohol-deasphalted short residue. The methods include performing deasphalting on a vacuum resid fraction with a deasphalting solvent comprising a mixture of an alkane, such as pentane, and one or more short chain alcohols, such as methanol and isopropyl alcohol. The deasphalted oil is then hydrotreated, followed by solvent extraction to perform sufficient VI uplift to form lubricating oils.

U.S. Pat. No. 7,776,206 describes methods for catalytically processing resids and/or deasphalted oils to form bright stock. A resid-derived stream, such as a deasphalted oil, is hydroprocessed to reduce the sulfur content to less than 1 wt % and reduce the nitrogen content to less than 0.5 wt %. The hydroprocessed stream is then fractionated to form a heavier fraction and a lighter fraction at a cut point between 1150° F.-1300° F. (620° C.-705° C.). The lighter fraction is then catalytically processed in various manners to form a bright stock.

SUMMARY

In an aspect, a method for making lubricant base stock is provided. The method includes performing solvent deasphalting, under effective solvent deasphalting conditions on a feedstock having a T5 boiling point of 370° C. or more and a T50 of 510° C. or more, the effective solvent deasphalting conditions producing a yield of deasphalted oil of 40 wt % or more of the feedstock. The method further includes hydroprocessing at least a portion of the deasphalted oil under first effective hydroprocessing conditions to form a hydroprocessed effluent, the at least a portion of the deasphalted oil having an aromatics content of 60 wt % or more, the hydroprocessed effluent comprising a sulfur content of 300 wppm or less, a nitrogen content of 100 wppm or less, or a combination thereof. The method further includes separating, from the hydroprocessed effluent, at least a fuels boiling range fraction, a first fraction comprising polynuclear aromatics and having a $T_5$ distillation point of at least 370° C., and a second fraction having a $T_5$ distillation point of at least 370° C., the second fraction having a higher kinematic viscosity at 100° C. than the first fraction. The method further includes hydroprocessing at least a portion of the first fraction under second effective hydroprocessing conditions, the second effective hydroprocessing conditions comprising catalytic dewaxing conditions, to form a twice-hydroprocessed effluent comprising a 370° C.+ portion having a first kinematic viscosity at 100° C. Additionally, the method includes i) exposing the at least a portion of the first fraction, prior to the hydroprocessing under second effective hydroprocessing conditions, to an adsorbent under aromatic adsorbent conditions to form an adsorbent effluent having a reduced content of polynuclear aromatics relative to the at least a portion of the first fraction prior to the exposing; ii) exposing at least a portion of the twice-hydroprocessed effluent, during or after the hydroprocessing under second effective hydroprocessing conditions, to an adsorbent under aromatic adsorbent conditions to form an adsorbent effluent having a reduced content of polynuclear aromatics relative to the at least a portion of the twice-hydroprocessed effluent prior to the exposing; or iii) a combination of i) and ii).

In another aspect, a method for making lubricant base stock is provided. The method includes performing solvent deasphalting, under effective solvent deasphalting conditions on a feedstock having a T5 boiling point of 370° C. or more and a T50 of 510° C. or more, the effective solvent deasphalting conditions producing a yield of deasphalted oil of 40 wt % or more of the feedstock. The method further includes hydroprocessing at least a portion of the deasphalted oil under first effective hydroprocessing conditions to form a hydroprocessed effluent, the at least a portion of the deasphalted oil having an aromatics content of 60 wt % or more, the hydroprocessed effluent comprising a sulfur content of 300 wppm or less, a nitrogen content of 100 wppm or less, or a combination thereof. The method further includes separating, from the hydroprocessed effluent, at least a fuels boiling range fraction, a first fraction comprising 6+ ring aromatics and having a $T_5$ distillation point of at least 370° C., and a second fraction having a $T_5$ distillation point of at least 370° C., the second fraction having a higher kinematic viscosity at 100° C. than the first fraction. The method further includes hydroprocessing at least a portion of the second fraction under second effective hydroprocessing conditions, the second effective hydroprocessing conditions comprising catalytic dewaxing conditions, to form a twice-hydroprocessed effluent comprising a 370° C.+ portion having a kinematic viscosity at 100° C. of 16 cSt or greater. Additionally, the method includes i) exposing the at least a portion of the second fraction, prior to the hydroprocessing under second effective hydroprocessing conditions, to an adsorbent under aromatic adsorbent conditions to form an adsorbent effluent having a reduced content of polynuclear aromatics relative to the at least a portion of the second fraction prior to the exposing; ii) exposing at least a portion of the twice-hydroprocessed effluent, during or after the hydroprocessing under second effective hydroprocessing conditions, to an adsorbent under aromatic adsorbent conditions to form an adsorbent effluent having a reduced content of polynuclear aromatics relative to the at least a portion of the twice-hydroprocessed effluent prior to the exposing; or iii) a combination of i) and ii).

In still another aspect, a method for making lubricant base stock is provided. The method includes performing solvent deasphalting, under effective solvent deasphalting conditions on a feedstock having a T5 boiling point of 370° C. or more and a T50 of 510° C. or more, the effective solvent deasphalting conditions producing a yield of deasphalted oil of 40 wt % or more of the feedstock. The method further includes hydroprocessing at least a portion of the deasphalted oil under first effective hydroprocessing conditions to form a hydroprocessed effluent, the at least a portion of the deasphalted oil having an aromatics content of 60 wt % or more, the hydroprocessed effluent comprising a sulfur content of 300 wppm or less, a nitrogen content of 100 wppm or less, or a combination thereof. The method further includes separating, from the hydroprocessed effluent, at least a fuels boiling range fraction, a first fraction comprising 6+ ring aromatics and having a $T_5$ distillation point of at least 370° C., and a second fraction having a $T_5$ distillation point of at least 370° C., the second fraction having a higher kinematic viscosity at 100° C. than the first fraction. The method further includes hydroprocessing at least a portion of the second fraction under second effective hydroprocessing conditions, the second effective hydroprocessing conditions comprising catalytic dewaxing conditions, to form a twice-hydroprocessed effluent comprising a 370° C.+ portion having a kinematic viscosity at 100° C. of 16 cSt or greater. The method further includes separating from at least a portion of the twice-hydprocessed effluent a third fraction and a fourth fraction, the fourth fraction having a higher kinematic viscosity at 100° C. than the third fraction. Additionally, the method includes exposing at least a portion of the third fraction to an adsorbent under aromatic adsorbent conditions to form an effluent having a reduced content of polynuclear aromatics relative to the at least a portion of the third fraction prior to the exposing.

In yet another aspect, a method for making lubricant base stock is provided. The method includes performing solvent deasphalting under effective solvent deasphalting conditions on a feedstock having a T5 boiling point of 370° C. or more and a T50 of 510° C. or more, the effective solvent deasphalting conditions producing a yield of deasphalted oil of 40 wt % or more of the feedstock. The method further includes hydroprocessing at least a portion of the deasphalted oil, under hydroprocessing conditions comprising an average hydroprocessing temperature of 400° C. or more and a LHSV of 1.0 $hr^{-1}$ or less, to form a hydroprocessed effluent, the at least a portion of the deasphalted oil comprising a sulfur content of 1000 wppm or more and an aromatics content of 60 wt % or more, the hydroprocessed effluent comprising a sulfur content of 300 wppm or less. Additionally, the method includes exposing at least a portion of the hydroprocessed effluent to an adsorbent under aromatic adsorbent conditions to form an adsorbent effluent having a reduced content of polynuclear aromatics relative to the at least a portion of the hydroprocessed effluent prior to the exposing.

In still another aspect, a lubricant boiling range composition is provided, the composition having a T5 boiling point of 370° C. or more, a T50 of 510° C. or more, a viscosity index of 80 or more, a kinematic viscosity at 100° C. of 6.0 cSt to 16 cSt, a pour point of −15° C. or less, and a polynuclear aromatics content of 0.01 wppm to 100 wppm.

DETAILED DESCRIPTION

Figure 1:
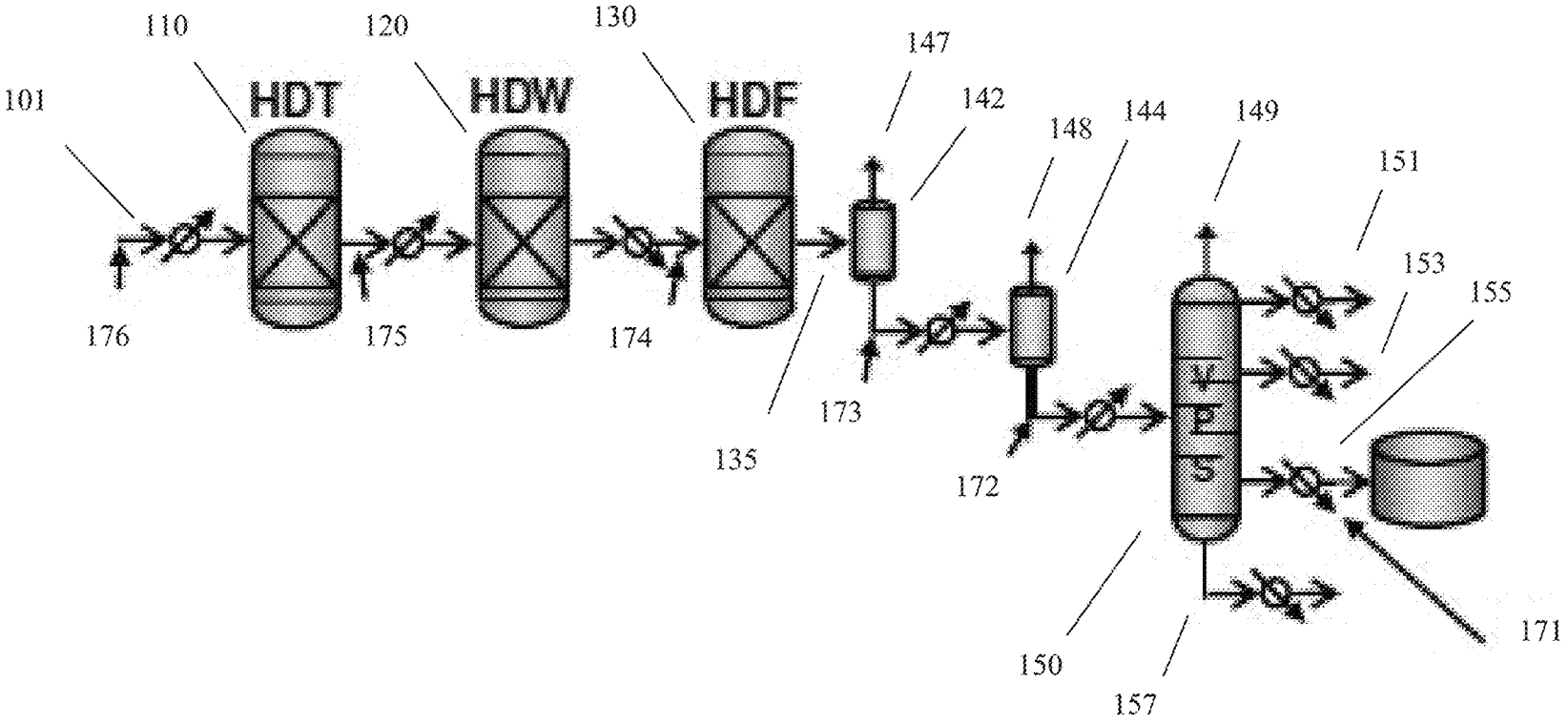
FIG. 1 shows examples of various sweet stage configurations for processing a deasphalted oil to form a lubricant base stock.

All numerical values within the detailed description and the claims herein are modified by "about" or "approximately" the indicated value, and take into account experimental error and variations that would be expected by a person having ordinary skill in the art.

Adsorbent Treatment of Base Stocks Derived from Deasphalted Oils

It would be desirable to have a process that provides high yields of high quality base stocks from deasphalted oils. It has been unexpectedly discovered that exposure of potential base stock fractions to an adsorbent during and/or after hydroprocessing can be beneficial for improving base stock quality by reducing or minimizing the amounts of polynuclear aromatics in the resulting base stock.

Some of the difficulties in producing lubricant base stocks, such as heavy neutral base stocks and/or bright stocks, can be related to the visual appearance of the base stock. Without being bound by any particular theory, it is believed that a variety of factors can result in haze formation and/or coloration in a lubricant base stock, either during processing, immediately after processing, or subsequent to processing (such as after sitting for a period of time). One of the factors that can contribute to haze formation and/or less desirable base stock color is the presence of aromatics within a base stock. For example, if a heavy neutral base stock contains an excess of heavy aromatic compounds, the heavy aromatic compounds may not stay completely in solution after formation of the heavy neutral base stock, which could result in the base stock having a hazy appearance over time. Similarly, some heavy aromatic compounds can contribute to giving heavy neutral base stocks and/or bright stocks a darker and/or opaque appearance.

Heavy polynuclear aromatics correspond to aromatic compounds that include three or more aromatic rings, or four or more aromatic rings, or six or more aromatic rings. Traditionally, the feeds used for production of heavy neutral lubricant base stocks have corresponded to virgin and/or lightly processed vacuum gas oil boiling range feeds. Such feeds typically have a lower content of polynuclear aromatics and therefore haze formation and/or the presence of color within the heavy neutral base stocks is of reduced concern.

One example of a lubricant production process that can result in production of heavy neutral base stocks and/or bright stocks with a high content of polynuclear aromatic compounds is production of base stocks from deasphalted oils. In particular, deasphalted oils formed using a solvent deasphalting process with a high yield of deasphalted oil (i.e., roughly 40 wt % or greater, or 50 wt % or greater), have an increased likelihood of containing high contents of aromatics, including polynuclear aromatics. The ability to form lubricant base stocks from a disadvantaged feed such as high lift deasphalted oil is potentially valuable, but it can be challenging using conventional processing methods to generate heavy neutral base stocks and/or bright stocks with desired levels of heavy polynuclear aromatics. In some aspects, the aromatics in a base stock derived from a deasphalted oil can have low amounts of non-aromatic carbon when compared to aromatic species in virgin feeds. For aromatic compounds in a base stock derived from a virgin feed or other traditional feed for formation of lubricant base stocks, the ratio of non-aromatic carbons to aromatic carbons within the aromatic compounds can range from roughly 1:2 to roughly 6:1. By contrast, for aromatic compounds in a heavy neutral base stock derived from a high lift deasphalted oil, the ratio of non-aromatic carbons to aromatic carbons can be from roughly 1:4 to roughly 3:1, or roughly 1:4 to roughly 2:1. Additionally or alternately, for polynuclear aromatic compounds having three or more aromatic rings (or four or more, or six or more), the ratio of non-aromatic carbons to aromatic carbons can be 1:6 or lower, or 1:8 or lower, such as down to 1:12, or possibly lower still. The ratio of non-aromatic carbons to aromatic carbons generally and/or in polynuclear aromatics can be determined, for example, using $^{13}$C-NMR.

In addition to any aromatics that may be present based on the nature of the feedstock, some polynuclear aromatics can be formed within the hydroprocessing environment at higher temperatures. For example, over the course of a hydroprocessing run, the temperature of a given reactor and/or reactor stage can be increased to account for deactivation of the catalyst during processing. When processing a deasphalted oil to make lubricant base stocks, one of the catalysts that can deactivate is a dewaxing catalyst in the sweet stage. The dewaxing catalyst can often be located near the end of the sweet stage processing train, with only a relatively low temperature hydrofinishing step after the catalytic dewaxing. As the dewaxing catalyst deactivates over the course of a processing run, the temperature in the dewaxing stage can increase to the point where additional heavy polynuclear aromatics can be formed. This can pose problems, as the conditions in the hydrofinishing stage can typically be selected to reduce the total aromatics content. This can require temperatures of 300° C. or less, or 250° C. or less in order to avoid equilibrium limitations on removal of aromatics in the presence of the hydrofinishing catalyst(s). However, such lower hydrofinishing temperatures can also make it difficult to remove polynuclear aromatics in the hydrofinishing stage.

As another example, a feedstock based in part on a deasphalted oil can include various components that are not typically present in a conventional vacuum gas oil feedstock for lubricant production. Some of these additional components can correspond to an increased percentage of aromatic compounds within the deasphalted oil. For example, a typical (vacuum gas oil) feed for lubricant base stock production can have an aromatics content of less than 70 wt %. By contrast, a feed based on a deasphalted oil can include 60 wt % or more of aromatic compounds, or 65 wt % or more, or 70 wt % or more, or 75 wt % or more, such as up to 85 wt % or possibly still higher. Other components can correspond to additional types of compounds containing contaminant heteroatoms (such as sulfur and/or nitrogen) that are desirable to remove from the resulting base stock product. Still other components can correspond to low viscosity index components that are desirable to modify (such as by cracking) in order to improve the properties of the resulting base stock product. The amount of aromatics in a feedstock or other fraction can be determined, for example, using ASTM 7419. Although the specification for this test method may indicate an upper limit for aromatics of less than 60 wt % in a test sample, it is believed that this method is suitable for characterization of aromatics contents of 60 wt % or more.

Based in part on the presence of these additional components, higher severity hydroprocessing conditions can be needed in the sour hydroprocessing stage during lubricant base stock production. However, these higher severity hydroprocessing conditions can result in additional formation of heavy polynuclear aromatics in the hydroprocessed effluent. Conventionally, these additional heavy polynuclear aromatics would result in base stock products with undesirable properties, such as undesirable color and/or undesirable haze formation over time. Examples of higher severity sour stage hydroprocessing conditions that can lead to additional formation of heavy polynuclear aromatics can include average hydroprocessing temperatures of 400° C. and a liquid hourly space velocity (LHSV) of 1.0 $hr^{-1}$ or less, or 0.5 $hr^{-1}$ or less, such as down to 0.05 $hr^{-1}$ or possibly still lower. The average hydroprocessing temperature is defined as the average temperature for all exposure to hydrotreating, hydrocracking, and aromatic saturation catalyst within a sour hydroprocessing stage. The sour hydroprocessing stage is defined as a stage including hydrotreating, hydrocracking, and/or aromatic saturation catalyst where the feed (derived from deasphalted oil) introduced into the stage has a sulfur content of 1000 wppm or more. Hydroprocessing stages are separated by one or more separators that are suitable for removing at least a light ends and/or naphtha boiling range portion of a hydroprocessed effluent from a lubricant boiling range portion of a hydroprocessed effluent. The same stage definition (corresponding to the same weight of catalyst) can be used for determining the average hydroprocessing temperature and the LHSV.

It has been unexpectedly discovered that heavy neutral base stock samples, such as heavy neutral base stocks derived (at least in part) from a deasphalted oil feed, can be corrected to have a reduced or minimized likelihood of haze formation by exposing the heavy neutral base stock to an aromatic adsorbent during or after hydroprocessing to form the base stock. Additionally or alternately, such an aromatic removal process based on adsorption can be beneficial for removing color from a bright stock and/or a heavy neutral base stock sample. Without being bound by any particular theory, it is believed that a suitable adsorbent, such as activated carbon, can remove high molecular weight polynuclear aromatics that can contribute to haze and/or color formation within a base stock. Removal of polynuclear aromatics using an adsorbent can reduce or minimize the yield loss associated with aromatics removal. This can be in contrast to, for example, aromatics removal methods based on solvent extraction and/or deep catalytic processing. Considerations for selection of adsorbents can include, but are not limited to, fast adsorption kinetics, high mesoporosity, high surface area, high mechanical strength, and high loading density.

In aspects where exposure to an adsorbent for aromatic adsorption is performed on a fraction comprising a heavy neutral base stock, the resulting heavy neutral base stock (after any optional additional processing) can correspond to a base stock with a kinematic viscosity at 100° C. of 6 cSt to 20 cSt, or 6 cSt to 16 cSt, or 6 cSt to 14 cSt, or 6 cSt to 12 cSt, or 8 cSt to 20 cSt, or 8 cSt to 16 cSt, or 8 cSt to 14 cSt, or 8 cSt to 12 cSt, or 10 cSt to 20 cSt, or 10 cSt to 16 cSt, or 10 cSt to 14 cSt. The viscosity index of the heavy neutral base stock can be at least 80, or at least 90, or at least 100, or at least 110, or at least 120. Additionally or alternately, the viscosity index of the heavy neutral base stock can be 80 to 160, or 80 to 140, or 80 to 120, or 90 to 160, or 90 to 140, or 90 to 120, or 100 to 160, or 100 to 140, or 120 to 160, or 120 to 140.

One option for characterizing the removal of polynuclear aromatics from a heavy neutral base stock is based on the color of the resulting base stock. Conventionally, a heavy neutral base stock would typically be produced from a virgin gas oil feed rather than a deasphalted oil formed by solvent deasphalting of a resid using a $C_{4+}$ solvent. In aspects where the feed for base stock production corresponds at least in part to a deasphalted oil (such as a deasphalted oil formed with a lift of 45% or more, or 50% or more), an increased amount of heavy polynuclear aromatics can be present in the heavy neutral base stock. In such aspects, for a heavy neutral base stock produced without exposure to an adsorbent, the Saybolt color of the base stock can be 18 or less, or 16 or less, or 14 or less, or 10 or less, such as down to 5 or possibly still lower. By contrast, exposing the heavy neutral base stock and/or an intermediate effluent from the production of the heavy neutral base stock to an adsorbent can allow for production of a heavy neutral base stock with a Saybolt color (ASTM D6045) of 12 or more, or 15 or more, or 18 or more, or 20 or more, or 22 or more. Additionally or alternately, the Saybolt color of an intermediate effluent or a final effluent from heavy neutral production can be characterized based on the Saybolt color of the intermediate effluent or final effluent both prior to and after exposure to an adsorbent. In various aspects, the Saybolt color of an intermediate effluent or final effluent after exposure to an adsorbent can be greater than the Saybolt color of the effluent prior to exposure to the adsorbent by two or more, or four or more.

Additionally or alternately, the weight of polynuclear aromatics in a heavy neutral base stock sample (and/or a sample suitable for formation of a heavy neutral base stock after further processing) can be determined by using a suitable technique, such as high pressure liquid chromatography (HPLC) coupled with fluorescence analysis. In various aspects, prior to exposure to an adsorbent, the amount of polynuclear aromatics (3+ ring, 4+ ring, or 6+ ring) in a heavy neutral base stock sample and/or a sample suitable for forming a heavy neutral base stock can be 0.01 wppm to 1000 wppm, or 0.01 wppm to 300 wppm, or 1.0 wppm to 1000 wppm, or 1.0 wppm to 300 wppm. After exposure to the adsorbent, the amount of polynuclear aromatics in the sample can be lower than the amount prior to exposure. This can result in a polynuclear aromatics content in the adsorbent effluent of less than 100 wppm, or less than 10 wppm, or less than 1.0 wppm, or less than 0.1 wppm, or less than 0.01 wppm, such as down to substantially no polynuclear aromatics.

In aspects where exposure to an adsorbent for aromatic adsorption is performed on a fraction comprising a bright stock, the resulting bright stock (after any optional additional processing) can correspond to a base stock with a kinematic viscosity at 100° C. of 16 cSt to 42 cSt, or 16 cSt to 36 cSt, or 16 cSt to 32 cSt, or 20 cSt to 42 cSt, or 20 cSt to 36 cSt, or 20 cSt to 32 cSt. The viscosity index of the bright stock can be at least 80, or at least 90, or at least 100, or at least 110, or at least 120. Additionally or alternately, the viscosity index of the heavy neutral base stock can be 80 to 160, or 80 to 140, or 80 to 120, or 90 to 160, or 90 to 140, or 90 to 120, or 100 to 160, or 100 to 140, or 120 to 160, or 120 to 140.

One option for characterizing the removal of heavy polynuclear aromatics from a bright stock is based on haze formation in the resulting bright stock. In aspects where the feed for base stock production corresponds at least in part to a deasphalted oil (such as a deasphalted oil formed with a lift of 45% or more, or 50% or more), an increased amount of heavy polynuclear aromatics can be present in the bright stock relative to bright stock formed from a conventional feed. The presence of increased polynuclear aromatics can be characterized, for example, based on visual haze or based on turbidity. The presence of increased polynuclear aromatics can be identified based on increased visual haze and/or increased turbidity. For example, a bright stock product including an increased amount of polynuclear aromatics can be visually rated (either immediately after production or after additional storage time) as showing trace or heavy haze. Additionally or alternately, the turbidity of a sample, as measured by visible light scattering, can show a turbidity of greater than 2 nephelometric turbidity units (NTU), or greater than 5 NTU, or greater than 10 NTU.

The weight of polynuclear aromatics in a bright stock sample (and/or a sample suitable for formation of a bright stock after further processing) can also be determined by using a suitable technique, such as high pressure liquid chromatography (HPLC) coupled with fluorescence analysis. In various aspects, prior to exposure to an adsorbent, the amount of polynuclear aromatics (3+ ring, 4+ ring, or 6+ ring) in a bright stock sample or a sample suitable for forming a bright stock can be 0.1 wppm to 10,000 wppm, or 0.1 wppm to 3000 wppm, or 10 wppm to 10,000 wppm, or 10 wppm to 3000 wppm. After exposure to the adsorbent, the amount of polynuclear aromatics in the sample can be lower than the amount prior to exposure. This can result in a polynuclear aromatics content in the adsorbent effluent of less than 1000 wppm, or less than 100 wppm, or less than 10 wppm, or less than 1.0 wppm, or less than 0.1 wppm, such as down to substantially no polynuclear aromatics.

Overview of Lubricant Base Stock Production from Deasphalted Oil

In various aspects, methods are provided for producing Group II/Group III lubricant base stocks, including Group II bright stocks and Group II/Group III heavy neutral base stocks, from deasphalted oils generated by low severity $C_{4+}$ deasphalting. Low severity deasphalting as used herein refers to deasphalting under conditions that result in a high yield of deasphalted oil (and/or a reduced amount of rejected asphalt or rock), such as a deasphalted oil yield of 40 wt % or more relative to the feed to deasphalting, or 45 wt % or more, or 50 wt % or more, or 55 wt % or more, or 60 wt % or more, or 70 wt % or more. The Group II base stocks (including bright stock) can be formed using a combination of catalytic and solvent processing. In contrast with conventional bright stock produced from deasphalted oil formed at low severity conditions, the bright stocks described herein can be substantially free from haze after storage for extended periods of time. It is believed that the reduced haze formation is due in part to the reduced or minimized differential between the pour point and the cloud point for the base stocks and/or due in part to forming a bright stock with a cloud point of −5° C. or less. Additionally or alternately, use of an adsorbent as described herein can allow deasphalted oil to be used for production of Group II heavy neutral base stock while achieving a desirable color value for the base stock.

Conventionally, crude oils are often described as being composed of a variety of boiling ranges. Lower boiling range compounds in a crude oil correspond to naphtha or kerosene fuels. Intermediate boiling range distillate compounds can be used as diesel fuel or as lubricant base stocks. If any higher boiling range compounds are present in a crude oil, such compounds are considered as residual or "resid" compounds, corresponding to the portion of a crude oil that is left over after performing atmospheric and/or vacuum distillation on the crude oil.

In some conventional processing schemes, a resid fraction is deasphalted, with the deasphalted oil used as part of a feed for forming lubricant base stocks. In such conventional processing schemes, the deasphalted oil used as feed for forming the lubricant base stocks is produced using propane deasphalting. This propane deasphalting corresponds to a "high severity" deasphalting, as indicated by a typical yield of deasphalted oil of 40 wt % or less, and more typically 30 wt % or less, relative to the initial resid fraction. In a typical lubricant base stock production process based on a deasphalted oil from propane deasphalting, the deasphalted oil can then be solvent extracted to reduce the aromatics content, followed by solvent dewaxing to form a base stock. The low yield of deasphalted oil is based in part on the inability of conventional methods to produce lubricant base stocks from lower severity deasphalting that do not form haze over time.

In some aspects, it has been discovered that catalytic processing (optionally including some solvent processing) can be used in conjunction with exposure to an adsorbent for aromatic compounds to produce lubricant base stocks from deasphalted oil while also producing Group II bright stocks that have little or no tendency to form haze over extended periods of time and/or Group II heavy neutral base stocks with a desirable color value. The deasphalted oil can be produced by deasphalting process that uses a $C_4$ solvent, a $C_5$ solvent, a $C_{6+}$ solvent, a mixture of two or more $C_{4+}$ solvents, or a mixture of two or more $C_{5+}$ solvents. The deasphalting process can further correspond to a process with a yield of deasphalted oil of 45 wt % or more for a vacuum resid feed having a T10 distillation point (or optionally a T5 distillation point) of at least 510° C., or a yield of at least 50 wt %, or at least 55 wt %, or at least 60 wt %.

For production of Group II bright stocks and/or Group II or Group III base stocks, a deasphalted oil can be hydroprocessed (hydrotreated and/or hydrocracked) in a sour stage at sufficient severity so that ~700° F.+(370° C.+) conversion is 10 wt % to 40 wt %. The hydroprocessed effluent can be fractionated to separate lower boiling portions from a lubricant base stock boiling range portion. The lubricant boiling range portion can then be further hydroprocessed (hydrotreated, hydrocracked, dewaxed, and/or hydrofinished) in a sweet processing stage to produce a catalytically dewaxed effluent. At one or more locations during and/or after the sweet hydroprocessing, at least a portion of the hydroprocessing effluent can be exposed to an adsorbent for removal of heavy polynuclear aromatics.

Optionally, the systems and methods described herein can be used in "block" operation to allow for additional improvements in yield and/or product quality. During "block" operation, a deaspahlted oil and/or the hydroprocessed effluent from the sour processing stage can be split into a plurality of fractions. The fractions can correspond, for example, to feed fractions suitable for forming a light neutral fraction, a heavy neutral fraction, and a bright stock fraction, or the plurality of fractions can correspond to any other convenient split into separate fractions. The plurality of separate fractions can then be processed separately in the process train (or in the sweet portion of the process train) for forming lubricant base stocks. For example, the light neutral portion of the feed can be processed for a period of time, followed by processing of the heavy neutral portion, followed by processing of a bright stock portion. During the time period when one type of fraction is being processed, storage tanks can be used to hold the remaining fractions.

Block operation can allow the processing conditions in the process train to be tailored to each type of lubricant fraction. For example, the amount of sweet processing stage conversion of the heavy neutral fraction can be lower than the amount of sweet processing stage conversion for the light neutral fraction. This can reflect the fact that heavy neutral lubricant base stocks may not need as high a viscosity index as light neutral base stocks.

Another option for modifying the production of base stocks can be to recycle a portion of at least one lubricant base stock product for further processing in the process train. This can correspond to recycling a portion of a base stock product for further processing in the sour stage and/or recycling a portion of a base stock product for further processing in the corresponding sweet stage. Optionally, a base stock product can be recycled for further processing in a different phase of block operation, such as recycling light neutral base stock product formed during block processing of the heavy neutral fraction for further processing during block processing of the light neutral fraction. The amount of base stock product recycled can correspond to any convenient amount of a base stock product effluent from the fractionator, such as 1 wt % to 50 wt % of a base stock product effluent, or 1 wt % to 20 wt %.

Recycling a portion of a base stock product effluent can optionally be used while operating a lube processing system at higher than typical levels of fuels conversion. When using a conventional feed for lubricant production, conversion of feed relative to 370° C. can be limited to 65 wt % or less. Conversion of more than 65 wt % of a feed relative to 370° C. is typically not favored due to loss of viscosity index with additional conversion. At elevated levels of conversion, the loss of VI with additional conversion is believed to be due to cracking and/or conversion of isoparaffins within a feed. For feeds derived from deasphalted oil, however, the amount of isoparaffins within a feed is lower than a conventional feed. As a result, additional conversion can be performed without loss of VI. In some aspects, converting at least 70 wt % of a feed, or at least 75 wt %, or at least 80 wt % can allow for production of lubricant base stocks with substantially improved cold flow properties while still maintaining the viscosity index of the products at a similar value to the viscosity index at a conventional conversion of 60 wt %.

In various aspects, a variety of combinations of catalytic and/or solvent processing can be used to form lubricant base stocks, including Group II bright stock, from deasphalted oils. These combinations include, but are not limited to:

a) Hydroprocessing of a deasphalted oil under sour conditions (i.e., sulfur content of at least 500 wppm); separation of the hydroprocessed effluent to form at least a lubricant boiling range fraction; and catalytic dewaxing of the lubricant boiling range fraction under sweet conditions (i.e., 500 wppm or less sulfur). The catalytic dewaxing can optionally correspond to catalytic dewaxing using a dewaxing catalyst with a pore size greater than 8.4 Angstroms. Optionally, the sweet processing conditions can further include hydrocracking, noble metal hydrotreatment, and/or hydrofinishing. The optional hydrocracking, noble metal hydrotreatment, and/or hydrofinishing can occur prior to and/or after catalytic dewaxing. For example, the order of catalytic processing under sweet processing conditions can be noble metal hydrotreating followed by hydrocracking followed by catalytic dewaxing.

b) The process of a) above, followed by performing an additional separation on at least a portion of the catalytically dewaxed effluent. The additional separation can correspond to solvent dewaxing, solvent extraction (such as solvent extraction with furfural or n-methylpyrollidone), a physical separation such as ultracentrifugation, exposure to an adsorbent for removal of aromatics (such as heavy polynuclear aromatics) or a combination thereof.

Group I base stocks or base oils are defined as base stocks with less than 90 wt % saturated molecules and/or at least 0.03 wt % sulfur content. Group I base stocks also have a viscosity index (VI) of at least 80 but less than 120. Group II base stocks or base oils contain at least 90 wt % saturated molecules and less than 0.03 wt % sulfur. Group II base stocks also have a viscosity index of at least 80 but less than 120. Group III base stocks or base oils contain at least 90 wt % saturated molecules and less than 0.03 wt % sulfur, with a viscosity index of at least 120.

In some aspects, a Group III base stock as described herein may correspond to a Group III+ base stock. Although a generally accepted definition is not available, a Group III+ base stock can generally correspond to a base stock that satisfies the requirements for a Group III base stock while also having at least one property that is enhanced relative to a Group III specification. The enhanced property can correspond to, for example, having a viscosity index that is substantially greater than the required specification of 120, such as a Group III base stock having a VI of at least 130, or at least 135, or at least 140. Similarly, in some aspects, a Group II base stock as described herein may correspond to a Group II+ base stock. Although a generally accepted definition is not available, a Group II+ base stock can generally correspond to a base stock that satisfies the requirements for a Group II base stock while also having at least one property that is enhanced relative to a Group II specification. The enhanced property can correspond to, for example, having a viscosity index that is substantially greater than the required specification of 80, such as a Group II base stock having a VI of at least 103, or at least 108, or at least 113.

In the discussion below, a stage can correspond to a single reactor or a plurality of reactors. Optionally, multiple parallel reactors can be used to perform one or more of the processes, or multiple parallel reactors can be used for all processes in a stage. Each stage and/or reactor can include one or more catalyst beds containing hydroprocessing catalyst. Note that a "bed" of catalyst in the discussion below can refer to a partial physical catalyst bed. For example, a catalyst bed within a reactor could be filled partially with a hydrocracking catalyst and partially with a dewaxing catalyst. For convenience in description, even though the two catalysts may be stacked together in a single catalyst bed, the hydrocracking catalyst and dewaxing catalyst can each be referred to conceptually as separate catalyst beds.

In this discussion, conditions may be provided for various types of hydroprocessing of feeds or effluents. Examples of hydroprocessing can include, but are not limited to, one or more of hydrotreating, hydrocracking, catalytic dewaxing, and hydrofinishing/aromatic saturation. Such hydroprocessing conditions can be controlled to have desired values for the conditions (e.g., temperature, pressure, LHSV, treat gas rate) by using at least one controller, such as a plurality of controllers, to control one or more of the hydroprocessing conditions. In some aspects, for a given type of hydroprocessing, at least one controller can be associated with each type of hydroprocessing condition. In some aspects, one or more of the hydroprocessing conditions can be controlled by an associated controller. Examples of structures that can be controlled by a controller can include, but are not limited to, valves that control a flow rate, a pressure, or a combination thereof; heat exchangers and/or heaters that control a temperature; and one or more flow meters and one or more associated valves that control relative flow rates of at least two flows. Such controllers can optionally include a controller feedback loop including at least a processor, a detector for detecting a value of a control variable (e.g., temperature, pressure, flow rate, and a processor output for controlling the value of a manipulated variable (e.g., changing the position of a valve, increasing or decreasing the duty cycle and/or temperature for a heater). Optionally, at least one hydroprocessing condition for a given type of hydroprocessing may not have an associated controller.

In this discussion, unless otherwise specified a lubricant boiling range fraction corresponds to a fraction having an initial boiling point or alternatively a T5 boiling point of at least about 370° C. (~700° F.). A distillate fuel boiling range fraction, such as a diesel product fraction, corresponds to a fraction having a boiling range from about 193° C. (375° F.) to about 370° C. (~700° F.). Thus, distillate fuel boiling range fractions (such as distillate fuel product fractions) can have initial boiling points (or alternatively T5 boiling points) of at least about 193° C. and final boiling points (or alternatively T95 boiling points) of about 370° C. or less. A naphtha boiling range fraction corresponds to a fraction having a boiling range from about 36° C. (122° F.) to about 193° C. (375° F.) to about 370° C. (~700° F.). Thus, naphtha fuel product fractions can have initial boiling points (or alternatively T5 boiling points) of at least about 36° C. and final boiling points (or alternatively T95 boiling points) of about 193° C. or less. It is noted that 36° C. roughly corresponds to a boiling point for the various isomers of a C5 alkane. A fuels boiling range fraction can correspond to a distillate fuel boiling range fraction, a naphtha boiling range fraction, or a fraction that includes both distillate fuel boiling range and naphtha boiling range components. Light ends are defined as products with boiling points below about 36° C., which include various C1-C4 compounds. When determining a boiling point or a boiling range for a feed or product fraction, an appropriate ASTM test method can be used, such as the procedures described in ASTM D2887, D2892, and/or D86. Preferably, ASTM D2887 should be used unless a sample is not appropriate for characterization based on ASTM D2887. For example, for samples that will not completely elute from a chromatographic column, ASTM D7169 can be used. A "Tx" boiling point refers to a fractional weight boiling point corresponding to the temperature where "x" wt % of a fraction will boil.

In this discussion, heavy polynuclear aromatics generally refer to aromatic compounds having three or more rings in the aromatic core of the compound, but if specified this definition can be limited to four or more rings, or six or more rings. For products that involve formation of at least one distillation intermediate, so that the resulting product is not formed only by processing the bottoms products from each distillation in the process, the heavy polynuclear aromatics can typically correspond to aromatic compounds having up to nine rings in the aromatic core. For example, in a process flow where both a heavy neutral base stock and a bright stock are produced, production of the heavy neutral base stock can include formation of at least one distillation intermediate while the bright stock may correspond to a product formed only from bottoms fractions during each distillation process. It is noted that aromatic compounds with ten or more rings in the aromatic core typically have high boiling points, and are not present in distillate fractions.

Adsorbents for Aromatic Compounds

In various aspects, an adsorbent suitable for selective adsorption of heavy polynuclear aromatics is used to remove heavy polynuclear aromatics from a base stock fraction, either during or after hydroprocessing to form the base stock fraction. Due to the nature of the hydroprocessing that is typically used for formation of a lubricant base stock, the aromatic content of a base stock fraction can be relatively low. This can make adsorption of heavy polynuclear aromatics feasible in a commercial scale process.

Adsorption of heavy polynuclear aromatics can be accomplished by exposing an input stream containing the heavy polynuclear aromatics to the adsorbent under effective adsorption conditions. The effective conditions can include an exposure temperature, an exposure residence time, the viscosity of the input stream, and the amount of adsorbent relative to the amount of the input stream. For example, the viscosity of the input stream to the adsorbent can be 15 cP or less at 150° C., or 13 cP or less, or 10 cP or less, such as down to 4 cP or possibly still lower. The exposure temperature can be 80° C. to 300° C., or 100° C. to 250° C., or 100° C. to 200° C., or 100° C. to 150° C. In aspects where activated carbon is used as the adsorbent, lower temperatures may be preferable, such as temperatures of 80° C. to 200° C., or 100° C. to 200° C., or 150° C. to 200° C., or 100° C. to 150° C. In aspects where the adsorbent corresponds to a zeolite (i.e., a material with a zeolitic framework structure), higher temperatures can be used but with a possible corresponding decrease in adsorbent capacity. The residence time can be 1 minute to 800 minutes, or 5 minutes to 120 minutes, or 10 minutes to 30 minutes. The ratio of the weight of the input stream relative to the weight of the adsorbent during the residence time can be from 2 to 10. It is noted that that the exposure conditions can be interdependent. For example, a higher viscosity input stream can tend to require a higher exposure temperature and/or a longer residence time in order to achieve a desired level of heavy polynuclear aromatics removal.

In some aspects, the viscosity of the input stream to the adsorbent can be 13 cP to 15 cP at 150° C. while the exposure temperature can be 160° C. to 250° C., or 160° C. to 200° C. In some aspects, the viscosity of the input stream to the adsorbent can be 10 cP to 13 cP at 150° C. while the exposure temperature can be 120° C. to 160° C. In some aspects, the viscosity of the input stream to the adsorbent can be 8 cP to 10 cP at 150° C. while the exposure temperature can be 80° C. to 120° C.

In some aspects, it can be desirable to modify the viscosity of the input stream to the adsorbent in order to facilitate adsorption of aromatics. A variety of hydrocarbon streams are potentially suitable as a solvent or diluent for addition to the input stream to an adsorbent. Desirable properties for the diluent can include, but are not limited to, a dynamic viscosity and/or kinematic viscosity that is lower than the input stream viscosity; an ability to separate the diluent from the base stock product after adsorption; and a low content of compounds that may be considered as less desirable in a lubricant base stock, such as aromatics, sulfur-containing compounds, or nitrogen-containing compounds. An example of a suitable diluent can be a distillate fuel boiling range portion of the fuels fraction generated by first (sour) hydroprocessing stage, the second (sweet) hydroprocessing stage, or a combination thereof. After performing sufficient hydroprocessing to make a low sulfur-content lubricant boiling range fraction, the amount of aromatics, sulfur, and/or nitrogen in a fuels fraction can be still lower than the corresponding amounts in the lubricant boiling range fraction. A distillate fuel boiling range portion of the fuels fraction can also be readily separated from a base stock fraction by distillation.

Activated carbon is an example of a suitable adsorbent for removal of heavy polynuclear aromatics. It is noted that activated carbon can also potentially adsorb other compounds that may be present in a hydroprocessed effluent that contains a base stock fraction. For example, activated carbon can potentially adsorb naphthenic compounds, partially unsaturated naphthenic compounds, and paraffinic compounds. In some aspects, the selectivity of activated carbon for adsorption of heavy polynuclear aromatics relative to naphthenic and/or paraffinic compounds can be enhanced by use of an activated carbon having an increased percentage of slit-like pores, as opposed to an activated carbon with an increased percentage of large pores and/or round pores. Additionally or alternately, adsorption of heavy polynuclear aromatics can potentially be increased by modifying the surface of the activated carbon to have an increased percentage of surface hydroxyl groups. This can increase the polarizability of the surface, which can assist with increasing the selectivity of compounds that can be partially polarized (such as aromatic ring structures) relative to compounds with low polarizability (hydrocarbons with little or no unsaturation). In some aspects, other adsorbents that can be used in place of or in addition to activated carbon for selective removal of heavy polynuclear aromatics can include, but are not limited to, attapulgus clay and/or other adsorbent clays, silica or alumina with greater than 10 $m^2/g$ BET surface area, porous polymer or resin, diatomaceous earth, or zeolite.

Exposure of an intermediate effluent or final effluent from base stock production to an adsorbent can be performed in any convenient manner. Typical configurations for an adsorbent correspond to standard packed beds, lead/lag configurations, parallel configurations, and any other configuration that allows for a sufficient residence time for contact of the intermediate effluent or final effluent with the adsorbent.

As an example, in some configurations, an adsorbent is provided in a plurality of vessels, such as two to twenty vessels. In such an example, during operation roughly half of the vessels can serve as an adsorbent vessel at any given time, while the other half of the vessels are undergoing regeneration and/or replacement of the adsorbent. Other options for staggering the usage of a plurality of vessels can also be used, such as having a first set of vessels operating as adsorbents, a second set of vessels being regenerated, and a third set of vessels that are waiting to be used as the adsorbent vessels. Within a vessel containing an adsorbent bed, the inner diameter of the bed can be from 1.0 m to 8.0 m, while the bed height can be from 5.0 m to 12.0 m. An intermediate or final effluent from base stock production can be exposed to the adsorbent for any convenient amount of contact time, such as a contact time of 10 minutes to 1000 minutes or possibly more.

Integration of Adsorbents for Aromatic Compounds with Lubricant Base Stock Production FIG. 1 schematically shows an example of the sweet stage portion of a process configuration for production of base stocks from a deasphalted oil. FIG. 1 shows various locations where the (partially) hydroprocessed effluent from the sweet stage can potentially be exposed to an adsorbent for removal of heavy polynuclear aromatic compounds.

In the exemplary sweet stage configuration shown in FIG. 1, reactors for hydrotreatment, catalytic dewaxing, and hydrofinishing are represented. It is understood that actual systems can include more than one type of catalyst in a reactor. As a few examples, hydrocracking catalyst can be included prior to and/or after hydrotreatment catalyst, dewaxing catalyst, or aromatic saturation catalyst in a reactor; dewaxing catalyst can be included prior to and/or after hydrotreatment catalyst, hydrocracking catalyst, aromatic saturation catalyst, hydrofinishing catalyst, or any other type of catalyst in a reactor; and hydrofinishing catalyst or aromatic saturation catalyst can appear at a variety of locations throughout hydroprocessing reactors. It is further noted that any convenient number of reactors can potentially be used. The choice of showing three reactors in FIG. 1 is for convenience in explaining the nature of the process.

The configuration shown in FIG. 1 also shows gas liquid type separators and a vacuum pipestill or other type of fractionation tower. More generally, any convenient types and combinations of separators or fractionators can be used to generate desired lubricant base stock product fractions.

In FIG. 1, the input feed 101 corresponds to a lubricant boiling range portion of the effluent from a prior sour processing stage. The input feed 101 is passed through various hydroprocessing stages, such as the hydrotreating/hydrocracking stage 110, catalytic dewaxing stage 120, and hydrofinishing stage 130 shown in FIG. 1. The resulting catalytically dewaxed 135 effluent (or hydroprocessed effluent) is then separated, such as using a high pressure, high temperature gas-liquid separator 142, a low pressure, high temperature gas-liquid separator 144, and a fractionation tower 150, to form various product fractions. The various product fractions include light ends fractions 147, 148, and 149, a fuels fraction 151, and various lubricant base stock fractions, such as a light neutral base stock fraction 153, a heavy neutral base stock fraction 155, and a bright stock fraction 157.

FIG. 1 further shows various locations where the hydroprocessed effluent (possibly at an intermediate stage of hydroprocessing) can be exposed to an adsorbent for removal of polynuclear aromatics. FIG. 1 shows six possible locations. In some aspects, an adsorbent is used in one of the locations represented in FIG. 1. In some aspects, an adsorbent is used at multiple locations within the sweet processing stage, such as two or more locations, or three or more locations. The first location for an adsorbent corresponds to exposing a base stock fraction to the adsorbent after fractionation, such as exposing heavy neutral base stock fraction 155 to adsorbent 171. The second location and third location correspond to locations for exposing the liquid portion of the hydroprocessed effluent 135 to an adsorbent 172 and/or 173 prior to entering fractionation tower 150. The fourth location corresponds to exposing the partially hydroprocessed effluent 125 from catalytic dewaxing stage 120 to an adsorbent 174 prior to entering hydrofinishing stage 130. The fifth location corresponds to exposing hydrotreated effluent 115 to adsorbent 175 prior to entering catalytic dewaxing stage 120. The sixth location corresponds to exposing the input feed 101 to an adsorbent 176 prior to entering hydrotreatment stage 110. It is noted that heaters, heat exchangers, valves, and other typical components of a reaction system may also be present in the configuration, such as the heat exchangers for heating and cooling of the input feed and the various intermediate streams as shown in FIG. 1.

A configuration that includes adsorbent bed 171 corresponds to a configuration where the heavy polynuclear aromatics are removed after separation of desired lubricant base stock cuts from the hydroprocessed effluent. Even for a reaction system operated in block mode, the hydroprocessing will result in some conversion of the input feed to the sweet stage. The fractionation tower 150 can be used to remove lower boiling fractions from the final product. In the configuration shown in FIG. 1, adsorbent bed 171 is used to adsorb aromatics from an intermediate boiling range product. This could correspond to a block processing situation where the input feed to the sweet stage corresponds to a bright stock feed. The fractionation tower 150 can be used to separate a light neutral fraction 153 and a heavy neutral fraction 155 from the bright stock fraction 157. In the configuration shown in FIG. 1, the adsorbent 171 is used to remove heavy polynuclear aromatics from the heavy neutral fraction 155. This can potentially reduce the amount of hydroprocessed effluent that needs to be exposed to the adsorbent under aromatic adsorption conditions. Additionally or alternately, because hydroprocessing has been completed, the pressure of the effluent for adsorbent 171 can be lower without having to incur energy costs for subsequent re-pressurization of the effluent. However, if it is desirable to incorporate a solvent into the heavy neutral fraction 155 to facilitate adsorption, an additional separation stage (not shown) would need to be added to remove such solvent from the heavy neutral base stock product.

One advantage of a configuration that includes adsorbent 171 is that the resulting base stock fraction (heavy neutral or bright stock) can be at a reduced temperature prior to entering the adsorbent, since sweet stage hydroprocessing and subsequent fractionation have been completed. However, the reduced temperature means that the base stock fraction can have a correspondingly higher dynamic viscosity. For a heavy neutral fraction passing through adsorbent 171, a suitable adsorbent temperature can be 100° C., which would correspond to a dynamic viscosity of between 8.0 cP and 15 cP (depending on how the heavy neutral fraction is cut). For a bright stock fraction passing through adsorbent 171, the dynamic viscosity at 100° C. can often be 30 cP or more, which can potentially slow the removal of polynuclear aromatics in the adsorbent. Thus, longer residence times may be beneficial for exposing a bright stock to an adsorbent and/or it may be desirable to expose a bright stock to the adsorbent at a higher temperature, such as 150° C. or more, or 200° C. or more, such as up to 300° C. or possibly still higher. As noted above, introducing a solvent to reduce the dynamic viscosity may be less preferable for adsorbent 171, since adsorbent 171 is located after the final separator in the separation stage.

It is noted that adsorbent 171 is located within the conduit from fractionation tower to a holding tank. As an alternative, adsorbent 171 could instead be located in a recirculation loop (not shown) associated with a holding tank. Still another alternative could be to place adsorbent 171 in the location shown and to include an additional adsorbent in a recirculation loop associated with a holding tank.

A configuration that includes adsorbent 172 and/or adsorbent 173 corresponds to a configuration where the heavy polynuclear aromatics are removed after hydroprocessing is finished but prior to fractionation to form desired base stock products. At these positions, the hydroprocessed effluent substantially corresponds to a liquid phase effluent, due to removal of gas phase compounds by gas-liquid separator 142 and/or gas-liquid separator 144. Additionally, because fractionation tower 150 is located after adsorbent 172 and/or adsorbent 173, a solvent or diluent can be introduced into the effluent prior to adsorption. This can allow for modification of the viscosity of the input stream to the adsorbent. In some aspects, an input stream to an adsorbent 173 can be at a slightly lower temperature than an input stream to an adsorbent 172, which can reduce the amount of cooling and re-heating that needs to be performed due to the adsorption process. The pressure of the hydroprocessed effluent after gas-liquid separator 142 and/or gas-liquid separator 144 can also be reduced relative to the typical pressures in a hydroprocessing environment. This can allow adsorbent 172 and/or adsorbent 173 to be housed in a housing with a reduced wall thickness relative to the wall thickness that may be needed for adsorbent 174, adsorbent 175, and/or adsorbent 176.

A configuration that includes adsorbent 174 corresponds to a configuration where the heavy polynuclear aromatics are removed after hydrotreating/hydrocracking 110 and after catalytic dewaxing 120, but prior to hydrofinishing 130. At this location the (partially) hydroprocessed effluent can correspond to a mixed phase due to $H_2$ added to facilitate hydroprocessing as well as due to light ends generated during hydroprocessing. Removing heavy polynuclear aromatics using adsorbent 174 could potentially improve the operation of hydrofinishing 130. Optionally, a diluent or solvent can be added prior to passing the (partially) hydroprocessed effluent in to adsorbent 174, in order to achieve a desired viscosity. However, such a diluent would then also be passed into hydrofinishing 130. Optionally, a gas-liquid separator could be included prior to adsorbent 174, but this can increase the operational cost due to the need to re-pressurize the effluent after adsorption as well as the need to add additional hydrogen to facilitate the hydrofinishing 130.

An effluent at the location of adsorbent 172, 173, or 174 can typically be at a temperature of 200° C. to 250° C. In some aspects, the effluent is exposed to the adsorbent at the combination of temperature and pressure expected at adsorbent location 172, 173, or 174. In some aspects, a temperature of 200° C. to 250° C. is above the typical temperature for exposure to the adsorbent, so some cooling and then re-heating may be needed. The effluent at the location of adsorbent 172, 173, or 174 can have a viscosity near 1.0 cP, with slightly higher viscosities for an effluent generated during bright stock block processing and slightly lower viscosities for an effluent generated during heavy neutral block processing. Without being bound by any particular theory, it is believed that the similar viscosities at the locations of adsorbents 172, 173, and 174 during heavy neutral and bright stock processing can be due to additional cracking performed for formation of bright stock. The additional cracking can lead to additional formation of lower boiling components that can act as a low viscosity diluent.

A configuration that includes adsorbent 175 corresponds to a configuration where the heavy polynuclear aromatics are removed after hydrotreating/hydrocracking 110, but prior to catalytic dewaxing 120 and hydrofinishing 130. At this location the (partially) hydroprocessed effluent can correspond to a mixed phase due to $H_2$ added to facilitate hydroprocessing as well as due to light ends generated during hydroprocessing. Because the hydrotreated/hydrocracked effluent from hydrotreating/hydrocracking 110 may contain a higher amount of waxy molecules, the adsorbing conditions for adsorbent 175 may correspond to a higher temperature range in order to reduce the viscosity of the input stream to the adsorbent. Optionally, a diluent or solvent can be added prior to passing the (partially) hydroprocessed effluent in to adsorbent 175, in order to achieve a desired viscosity. However, such a diluent would then also be passed into catalytic dewaxing 120 and hydrofinishing 130. Optionally, a gas-liquid separator could be included prior to adsorbent 175, but this can increase the operational cost due to the need to re-pressurize the effluent after adsorption as well as the need to add additional hydrogen to facilitate catalytic dewaxing 120 and hydrofinishing 130.

An effluent at the location of adsorbent 175 can typically be at a temperature of 300° C. to 360° C. This is above the typical temperature for exposure to an adsorbent, so some cooling and then re-heating may be needed. The effluent at the location of adsorbent 175 can have a viscosity below 1.0 cP, with slightly higher viscosities for an effluent generated during bright stock block processing and slightly lower viscosities for an effluent generated during heavy neutral block processing.

A configuration that includes adsorbent 176 corresponds to a configuration where the heavy polynuclear aromatics are removed prior to hydrotreating/hydrocracking 110, catalytic dewaxing 120, and hydrofinishing 130. At this location the feed has not started sweet stage hydroprocessing. Based on prior separations from the sour stage, the feed can correspond to a liquid feed, and temperature and pressure can be selected as desired prior to heating and/or repressurization for introduction into hydrotreating/hydrocracking 110. Although the entire feed to the sweet stage is exposed to adsorbent 110, removal of aromatics prior to the start of hydroprocessing can potentially improve the operation of the hydroprocessing stages. This could potentially allow, for example, an increase in the space velocity in the subsequent hydroprocessing reactors while still achieving desired product quality targets. Such a decrease in reaction severity can be beneficial for reducing or minimizing the creation of additional aromatics during hydroprocessing.

One advantage of including adsorbent 176 can be that the input feed to the adsorbent can be at a reduced temperature prior to entering the adsorbent, since sweet stage processing has not started yet. This may involve cooling of a fraction derived from a fractionation tower after the sour stage. However, the reduced temperature means that the input feed can have a correspondingly higher dynamic viscosity. For a heavy neutral fraction passing through adsorbent 176, a suitable adsorbent temperature can be 100° C., which would correspond to a dynamic viscosity of between 8.0 cP and 15 cP (depending on how the heavy neutral fraction is cut). For a bright stock fraction passing through adsorbent 176, the dynamic viscosity at 100° C. can often be 30 cP or more, which can potentially slow the removal of polynuclear aromatics in the adsorbent. Thus, longer residence times may be beneficial for exposing a bright stock to an adsorbent and/or it may be desirable to expose a bright stock to the adsorbent at a higher temperature, such as 150° C. or more, or 200° C. or more, such as up to 300° C. or possibly still higher.

Feedstocks

In various aspects, at least a portion of a feedstock for processing as described herein can correspond to a vacuum resid fraction or another type 950° F.+(510° C.+) or 1000° F.+(538° C.+) fraction. Another example of a method for forming a 950° F.+(510° C.+) or 1000° F.+(538° C.+) fraction is to perform a high temperature flash separation. The 950° F.+(510° C.+) or 1000° F.+(538° C.+) fraction formed from the high temperature flash can be processed in a manner similar to a vacuum resid.

A vacuum resid fraction or a 950° F.+(510° C.+) fraction formed by another process (such as a flash fractionation bottoms or a bitumen fraction) can be deasphalted at low severity to form a deasphalted oil. Optionally, the feedstock can also include a portion of a conventional feed for lubricant base stock production, such as a vacuum gas oil.

A vacuum resid (or other 510° C.+) fraction can correspond to a fraction with a T5 distillation point (ASTM D2892, or ASTM D7169 if the fraction will not completely elute from a chromatographic system) of at least about 900° F. (482° C.), or at least 950° F. (510° C.), or at least 1000° F. (538° C.). Alternatively, a vacuum resid fraction can be characterized based on a T10 distillation point (ASTM D2892/D7169) of at least about 900° F. (482° C.), or at least 950° F. (510° C.), or at least 1000° F. (538° C.).

Resid (or other 510° C.+) fractions can be high in metals. For example, a resid fraction can be high in total nickel, vanadium and iron contents. In an aspect, a resid fraction can contain at least 0.00005 grams of Ni/V/Fe (50 wppm) or at least 0.0002 grams of Ni/V/Fe (200 wppm) per gram of resid, on a total elemental basis of nickel, vanadium and iron. In other aspects, the heavy oil can contain at least 500 wppm of nickel, vanadium, and iron, such as up to 1000 wppm or more.

Contaminants such as nitrogen and sulfur are typically found in resid (or other 510° C.+) fractions, often in organically-bound form. Nitrogen content can range from about 50 wppm to about 10,000 wppm elemental nitrogen or more, based on total weight of the resid fraction. Sulfur content can range from 500 wppm to 100,000 wppm elemental sulfur or more, based on total weight of the resid fraction, or from 1000 wppm to 50,000 wppm, or from 1000 wppm to 30,000 wppm.

Still another method for characterizing a resid (or other 510° C.+) fraction is based on the Conradson carbon residue (CCR) of the feedstock. The Conradson carbon residue of a resid fraction can be at least about 5 wt %, such as at least about 10 wt % or at least about 20 wt %. Additionally or alternately, the Conradson carbon residue of a resid fraction can be about 50 wt % or less, such as about 40 wt % or less or about 30 wt % or less.

In some aspects, a vacuum gas oil fraction can be co-processed with a deasphalted oil. The vacuum gas oil can be combined with the deasphalted oil in various amounts ranging from 20 parts (by weight) deasphalted oil to 1 part vacuum gas oil (i.e., 20:1) to 1 part deasphalted oil to 1 part vacuum gas oil. A feed with a 1:1 ratio of deasphalted oil to vacuum gas oil can correspond to, for example, a feed with a T50 distillation point of 510° C. or more. In some aspects, the ratio of deasphalted oil to vacuum gas oil can be at least 1:1 by weight, or at least 1.5:1, or at least 2:1. Typical (vacuum) gas oil fractions can include, for example, fractions with a T5 distillation point to T95 distillation point of 650° F. (343° C.)-1050° F. (566° C.), or 650° F. (343° C.)-1000° F. (538° C.), or 650° F. (343° C.)-950° F. (510° C.), or 650° F. (343° C.)-900° F. (482° C.), or ~700° F. (370° C.)-1050° F. (566° C.), or ~700° F. (370° C.)-1000° F. (538° C.), or ~700° F. (370° C.)-950° F. (510° C.), or ~700° F. (370° C.)-900° F. (482° C.), or 750° F. (399° C.)-1050° F. (566° C.), or 750° F. (399° C.)-1000° F. (538° C.), or 750° F. (399° C.)-950° F. (510° C.), or 750° F. (399° C.)-900° F. (482° C.). For example a suitable vacuum gas oil fraction can have a T5 distillation point of at least 343° C. and a T95 distillation point of 566° C. or less; or a T10 distillation point of at least 343° C. and a T90 distillation point of 566° C. or less; or a T5 distillation point of at least 370° C. and a T95 distillation point of 566° C. or less; or a T5 distillation point of at least 343° C. and a T95 distillation point of 538° C. or less.

Solvent Deasphalting

Solvent deasphalting is a solvent extraction process. In some aspects, suitable solvents for methods as described herein include alkanes or other hydrocarbons (such as alkenes) containing 4 to 7 carbons per molecule. Examples of suitable solvents include n-butane, isobutane, n-pentane, $C_{4+}$ alkanes, $C_{5+}$ alkanes, $C_{4+}$ hydrocarbons, and $C_{5+}$ hydrocarbons. In other aspects, suitable solvents can include $C_3$ hydrocarbons, such as propane. In such other aspects, examples of suitable solvents include propane, n-butane, isobutane, n-pentane, $C_{3+}$ alkanes, $C_{4+}$ alkanes, $C_{5+}$ alkanes, $C_{3+}$ hydrocarbons, $C_{4+}$ hydrocarbons, and $C_{5+}$ hydrocarbons In this discussion, a solvent comprising $C_n$ (hydrocarbons) is defined as a solvent composed of at least 80 wt % of alkanes (hydrocarbons) having n carbon atoms, or at least 85 wt %, or at least 90 wt %, or at least 95 wt %, or at least 98 wt %. Similarly, a solvent comprising $C_{n+}$ (hydrocarbons) is defined as a solvent composed of at least 80 wt % of alkanes (hydrocarbons) having n or more carbon atoms, or at least 85 wt %, or at least 90 wt %, or at least 95 wt %, or at least 98 wt %.

In this discussion, a solvent comprising $C_n$ alkanes (hydrocarbons) is defined to include the situation where the solvent corresponds to a single alkane (hydrocarbon) containing n carbon atoms (for example, n=3, 4, 5, 6, 7) as well as the situations where the solvent is composed of a mixture of alkanes (hydrocarbons) containing n carbon atoms. Similarly, a solvent comprising $C_{n+}$ alkanes (hydrocarbons) is defined to include the situation where the solvent corresponds to a single alkane (hydrocarbon) containing n or more carbon atoms (for example, n=3, 4, 5, 6, 7) as well as the situations where the solvent corresponds to a mixture of alkanes (hydrocarbons) containing n or more carbon atoms. Thus, a solvent comprising $C_{4+}$ alkanes can correspond to a solvent including n-butane; a solvent including n-butane and isobutane; a solvent including n-pentane; a solvent corresponding to a mixture of one or more butane isomers and one or more pentane isomers; or any other convenient combination of alkanes containing 4 or more carbon atoms. Similarly, a solvent comprising $C_{5+}$ alkanes (hydrocarbons) is defined to include a solvent corresponding to a single alkane (hydrocarbon) or a solvent corresponding to a mixture of alkanes (hydrocarbons) that contain 5 or more carbon atoms. Alternatively, other types of solvents may also be suitable, such as supercritical fluids. In various aspects, the solvent for solvent deasphalting can consist essentially of hydrocarbons, so that at least 98 wt % or at least 99 wt % of the solvent corresponds to compounds containing only carbon and hydrogen. In aspects where the deasphalting solvent corresponds to a $C_{4+}$ deasphalting solvent, the $C_{4+}$ deasphalting solvent can include less than 15 wt % propane and/or other $C_3$ hydrocarbons, or less than 10 wt %, or less than 5 wt %, or the $C_{4+}$ deasphalting solvent can be substantially free of propane and/or other $C_3$ hydrocarbons (less than 1 wt %). In aspects where the deasphalting solvent corresponds to a $C_{5+}$ deasphalting solvent, the $C_{5+}$ deasphalting solvent can include less than 15 wt % propane, butane and/or other $C_3$-$C_4$ hydrocarbons, or less than 10 wt %, or less than 5 wt %, or the $C_{5+}$ deasphalting solvent can be substantially free of propane, butane, and/or other $C_3$-$C_4$ hydrocarbons (less than 1 wt %). In aspects where the deasphalting solvent corresponds to a $C_{3+}$ deasphalting solvent, the $C_{3+}$ deasphalting solvent can include less than 10 wt % ethane and/or other $C_2$ hydrocarbons, or less than 5 wt %, or the $C_{3+}$ deasphalting solvent can be substantially free of ethane and/or other $C_2$ hydrocarbons (less than 1 wt %).

Deasphalting of heavy hydrocarbons, such as vacuum resids, is known in the art and practiced commercially. A deasphalting process typically corresponds to contacting a heavy hydrocarbon with an alkane solvent (propane, butane, pentane, hexane, heptane etc and their isomers), either in pure form or as mixtures, to produce two types of product streams. One type of product stream can be a deasphalted oil extracted by the alkane, which is further separated to produce deasphalted oil stream. A second type of product stream can be a residual portion of the feed not soluble in the solvent, often referred to as rock or asphaltene fraction. The deasphalted oil fraction can be further processed into make fuels or lubricants. The rock fraction can be further used as blend component to produce asphalt, fuel oil, and/or other products. The rock fraction can also be used as feed to gasification processes such as partial oxidation, fluid bed combustion or coking processes. The rock can be delivered to these processes as a liquid (with or without additional components) or solid (either as pellets or lumps).

During solvent deasphalting, a resid boiling range feed (optionally also including a portion of a vacuum gas oil feed) can be mixed with a solvent. Portions of the feed that are soluble in the solvent are then extracted, leaving behind a residue with little or no solubility in the solvent. The portion of the deasphalted feedstock that is extracted with the solvent is often referred to as deasphalted oil. Typical solvent deasphalting conditions include mixing a feedstock fraction with a solvent in a weight ratio of from about 1:2 to about 1:10, such as about 1:8 or less. Typical solvent deasphalting temperatures range from 40° C. to 200° C., or 40° C. to 150° C., depending on the nature of the feed and the solvent. The pressure during solvent deasphalting can be from about 50 psig (345 kPag) to about 500 psig (3447 kPag).

It is noted that the above solvent deasphalting conditions represent a general range, and the conditions will vary depending on the feed. For example, under typical deasphalting conditions, increasing the temperature can tend to reduce the yield while increasing the quality of the resulting deasphalted oil. Under typical deasphalting conditions, increasing the molecular weight of the solvent can tend to increase the yield while reducing the quality of the resulting deasphalted oil, as additional compounds within a resid fraction may be soluble in a solvent composed of higher molecular weight hydrocarbons. Under typical deasphalting conditions, increasing the amount of solvent can tend to increase the yield of the resulting deasphalted oil. As understood by those of skill in the art, the conditions for a particular feed can be selected based on the resulting yield of deasphalted oil from solvent deasphalting. In aspects where a $C_3$ deasphalting solvent is used, the yield from solvent deasphalting can be 40 wt % or less. In some aspects, $C_4$ deasphalting can be performed with a yield of deasphalted oil of 50 wt % or less, or 40 wt % or less. In various aspects, the yield of deasphalted oil from solvent deasphalting with a $C_{4+}$ solvent can be at least 50 wt % relative to the weight of the feed to deasphalting, or at least 55 wt %, or at least 60 wt % or at least 65 wt %, or at least 70 wt %. In aspects where the feed to deasphalting includes a vacuum gas oil portion, the yield from solvent deasphalting can be characterized based on a yield by weight of a 950° F.+(510° C.) portion of the deasphalted oil relative to the weight of a 510° C.+ portion of the feed. In such aspects where a $C_{4+}$ solvent is used, the yield of 510° C.+ deasphalted oil from solvent deasphalting can be at least 40 wt % relative to the weight of the 510° C.+ portion of the feed to deasphalting, or at least 50 wt %, or at least 55 wt %, or at least 60 wt % or at least 65 wt %, or at least 70 wt %. In such aspects where a $C_{4-}$ solvent is used, the yield of 510° C.+ deasphalted oil from solvent deasphalting can be 50 wt % or less relative to the weight of the 510° C.+ portion of the feed to deasphalting, or 40 wt % or less, or 35 wt % or less.

Hydrotreating and Hydrocracking

After deasphalting, the deasphalted oil (and any additional fractions combined with the deasphalted oil) can undergo further processing to form lubricant base stocks. This can include hydrotreatment and/or hydrocracking to remove heteroatoms to desired levels, reduce Conradson Carbon content, and/or provide viscosity index (VI) uplift. Depending on the aspect, a deasphalted oil can be hydroprocessed by hydrotreating, hydrocracking, or hydrotreating and hydrocracking. Optionally, one or more catalyst beds and/or stages of demetallization catalyst can be included prior to the initial bed of hydrotreating and/or hydrocracking catalyst. Optionally, the hydroprocessing can further include exposing the deasphalted oil to a base metal aromatic saturation catalyst. It is noted that a base metal aromatic saturation catalyst can sometimes be similar to a lower activity hydrotreating catalyst.

The deasphalted oil can be hydrotreated and/or hydrocracked with little or no solvent extraction being performed prior to and/or after the deasphalting. As a result, the deasphalted oil feed for hydrotreatment and/or hydrocracking can have a substantial aromatics content. In various aspects, the aromatics content of the deasphalted oil feed can be at least 50 wt %, or at least 55 wt %, or at least 60 wt %, or at least 65 wt %, or at least 70 wt %, or at least 75 wt %, such as up to 90 wt % or more. Additionally or alternately, the saturates content of the deasphalted oil feed can be 50 wt % or less, or 45 wt % or less, or 40 wt % or less, or 35 wt % or less, or 30 wt % or less, or 25 wt % or less, such as down to 10 wt % or less. In this discussion and the claims below, the aromatics content and/or the saturates content of a fraction can be determined based on ASTM D7419. As noted above, it is believed that this method is suitable for characterization of the aromatics and/or saturates levels described herein.

The reaction conditions during demetallization and/or hydrotreatment and/or hydrocracking of the deasphalted oil (and optional vacuum gas oil co-feed) can be selected to generate a desired level of conversion of a feed. Any convenient type of reactor, such as fixed bed (for example trickle bed) reactors can be used. Conversion of the feed can be defined in terms of conversion of molecules that boil above a temperature threshold to molecules below that threshold. The conversion temperature can be any convenient temperature, such as ~700° F. (370° C.) or 1050° F. (566° C.). The amount of conversion can correspond to the total conversion of molecules within the combined hydrotreatment and hydrocracking stages for the deasphalted oil. Suitable amounts of conversion of molecules boiling above 1050° F. (566° C.) to molecules boiling below 566° C. include 30 wt % to 90 wt % conversion relative to 566° C., or 30 wt % to 80 wt %, or 30 wt % to 70 wt %, or 40 wt % to 90 wt %, or 40 wt % to 80 wt %, or 40 wt % to 70 wt %, or 50 wt % to 90 wt %, or 50 wt % to 80 wt %, or 50 wt % to 70 wt %. In particular, the amount of conversion relative to 566° C. can be 30 wt % to 90 wt %, or 30 wt % to 70 wt %, or 50 wt % to 90 wt %. Additionally or alternately, suitable amounts of conversion of molecules boiling above ~700° F. (370° C.) to molecules boiling below 370° C. include 10 wt % to 70 wt % conversion relative to 370° C., or 10 wt % to 60 wt %, or 10 wt % to 50 wt %, or 20 wt % to 70 wt %, or 20 wt % to 60 wt %, or 20 wt % to 50 wt %, or 30 wt % to 70 wt %, or 30 wt % to 60 wt %, or 30 wt % to 50 wt %. In particular, the amount of conversion relative to 370° C. can be 10 wt % to 70 wt %, or 20 wt % to 50 wt %, or 30 wt % to 60 wt %.

The hydroprocessed deasphalted oil can also be characterized based on the product quality. After hydroprocessing (hydrotreating and/or hydrocracking), the hydroprocessed deasphalted oil can have a sulfur content of 200 wppm or less, or 100 wppm or less, or 50 wppm or less (such as down to ~0 wppm). Additionally or alternately, the hydroprocessed deasphalted oil can have a nitrogen content of 200 wppm or less, or 100 wppm or less, or 50 wppm or less (such as down to ~0 wppm). Additionally or alternately, the hydroprocessed deasphalted oil can have a Conradson Carbon residue content of 1.5 wt % or less, or 1.0 wt % or less, or 0.7 wt % or less, or 0.1 wt % or less, or 0.02 wt % or less (such as down to ~0 wt %). Conradson Carbon residue content can be determined according to ASTM D4530.

In various aspects, a feed can initially be exposed to a demetallization catalyst prior to exposing the feed to a hydrotreating catalyst. Deasphalted oils can have metals concentrations (Ni+V+Fe) on the order of 10-100 wppm. Exposing a conventional hydrotreating catalyst to a feed having a metals content of 10 wppm or more can lead to catalyst deactivation at a faster rate than may desirable in a commercial setting. Exposing a metal containing feed to a demetallization catalyst prior to the hydrotreating catalyst can allow at least a portion of the metals to be removed by the demetallization catalyst, which can reduce or minimize the deactivation of the hydrotreating catalyst and/or other subsequent catalysts in the process flow. Commercially available demetallization catalysts can be suitable, such as large pore amorphous oxide catalysts that may optionally include Group VI and/or Group VIII non-noble metals to provide some hydrogenation activity.

In various aspects, the deasphalted oil can be exposed to a hydrotreating catalyst under effective hydrotreating conditions. The catalysts used can include conventional hydroprocessing catalysts, such as those comprising at least one Group VIII non-noble metal (Columns 8-10 of IUPAC periodic table), preferably Fe, Co, and/or Ni, such as Co and/or Ni; and at least one Group VI metal (Column 6 of IUPAC periodic table), preferably Mo and/or W. Such hydroprocessing catalysts optionally include transition metal sulfides that are impregnated or dispersed on a refractory support or carrier such as alumina and/or silica. The support or carrier itself typically has no significant/measurable catalytic activity. Substantially carrier- or support-free catalysts, commonly referred to as bulk catalysts, generally have higher volumetric activities than their supported counterparts.

The catalysts can either be in bulk form or in supported form. In addition to alumina and/or silica, other suitable support/carrier materials can include, but are not limited to, zeolites, titania, silica-titania, and titania-alumina. Suitable aluminas are porous aluminas such as gamma or eta having average pore sizes from 50 to 200 Å, or 75 to 150 Å; a surface area from 100 to 300 $m^2/g$, or 150 to 250 $m^2/g$; and a pore volume of from 0.25 to 1.0 $cm^3/g$, or 0.35 to 0.8 $cm^3/g$. More generally, any convenient size, shape, and/or pore size distribution for a catalyst suitable for hydrotreatment of a distillate (including lubricant base stock) boiling range feed in a conventional manner may be used. Preferably, the support or carrier material is an amorphous support, such as a refractory oxide. Preferably, the support or carrier material can be free or substantially free of the presence of molecular sieve, where substantially free of molecular sieve is defined as having a content of molecular sieve of less than about 0.01 wt %.

The at least one Group VIII non-noble metal, in oxide form, can typically be present in an amount ranging from about 2 wt % to about 40 wt %, preferably from about 4 wt % to about 15 wt %. The at least one Group VI metal, in oxide form, can typically be present in an amount ranging from about 2 wt % to about 70 wt %, preferably for supported catalysts from about 6 wt % to about 40 wt % or from about 10 wt % to about 30 wt %. These weight percents are based on the total weight of the catalyst. Suitable metal catalysts include cobalt/molybdenum (1-10% Co as oxide, 10-40% Mo as oxide), nickel/molybdenum (1-10% Ni as oxide, 10-40% Co as oxide), or nickel/tungsten (1-10% Ni as oxide, 10-40% W as oxide) on alumina, silica, silica-alumina, or titania.

The hydrotreatment is carried out in the presence of hydrogen. A hydrogen stream is, therefore, fed or injected into a vessel or reaction zone or hydroprocessing zone in which the hydroprocessing catalyst is located. Hydrogen, which is contained in a hydrogen "treat gas," is provided to the reaction zone. Treat gas, as referred to in this invention, can be either pure hydrogen or a hydrogen-containing gas, which is a gas stream containing hydrogen in an amount that is sufficient for the intended reaction(s), optionally including one or more other gasses (e.g., nitrogen and light hydrocarbons such as methane). The treat gas stream introduced into a reaction stage will preferably contain at least about 50 vol. % and more preferably at least about 75 vol. % hydrogen. Optionally, the hydrogen treat gas can be substantially free (less than 1 vol %) of impurities such as $H_2S$ and $NH_3$ and/or such impurities can be substantially removed from a treat gas prior to use.

Hydrogen can be supplied at a rate of from about 100 SCF/B (standard cubic feet of hydrogen per barrel of feed) (17 $Nm^3/m^3$) to about 10000 SCF/B (1700 $Nm^3/m^3$). Preferably, the hydrogen is provided in a range of from about 200 SCF/B (34 $Nm^3/m^3$) to about 2500 SCF/B (420 $Nm^3/m^3$). Hydrogen can be supplied co-currently with the input feed to the hydrotreatment reactor and/or reaction zone or separately via a separate gas conduit to the hydrotreatment zone.

Hydrotreating conditions can include temperatures of 200° C. to 450° C., or 315° C. to 425° C.; pressures of 250 psig (1.8 MPag) to 5000 psig (34.6 MPag) or 300 psig (2.1 MPag) to 3000 psig (20.8 MPag); liquid hourly space velocities (LHSV) of 0.1 $hr^{-1}$ to 10 $hr^{-1}$; and hydrogen treat rates of 200 scf/B (35.6 $m^3/m^3$) to 10,000 scf/B (1781 $m^3/m^3$), or 500 (89 $m^3/m^3$) to 10,000 scf/B (1781 $m^3/m^3$).

In various aspects, the deasphalted oil can be exposed to a hydrocracking catalyst under effective hydrocracking conditions. Hydrocracking catalysts typically contain sulfided base metals on acidic supports, such as amorphous silica alumina, cracking zeolites such as USY, or acidified alumina. Often these acidic supports are mixed or bound with other metal oxides such as alumina, titania or silica. Examples of suitable acidic supports include acidic molecular sieves, such as zeolites or silicoaluminophophates. One example of suitable zeolite is USY, such as a USY zeolite with cell size of 24.30 Angstroms or less. Additionally or alternately, the catalyst can be a low acidity molecular sieve, such as a USY zeolite with a Si to Al ratio of at least about 20, and preferably at least about 40 or 50. ZSM-48, such as ZSM-48 with a $SiO_2$ to $Al_2O_3$ ratio of about 110 or less, such as about 90 or less, is another example of a potentially suitable hydrocracking catalyst. Still another option is to use a combination of USY and ZSM-48. Still other options include using one or more of zeolite Beta, ZSM-5, ZSM-35, or ZSM-23, either alone or in combination with a USY catalyst. Non-limiting examples of metals for hydrocracking catalysts include metals or combinations of metals that include at least one Group VIII metal, such as nickel, nickel-cobalt-molybdenum, cobalt-molybdenum, nickel-tungsten, nickel-molybdenum, and/or nickel-molybdenum-tungsten. Additionally or alternately, hydrocracking catalysts with noble metals can also be used. Non-limiting examples of noble metal catalysts include those based on platinum and/or palladium. Support materials which may be used for both the noble and non-noble metal catalysts can comprise a refractory oxide material such as alumina, silica, alumina-silica, kieselguhr, diatomaceous earth, magnesia, zirconia, or combinations thereof, with alumina, silica, alumina-silica being the most common (and preferred, in one embodiment).

When only one hydrogenation metal is present on a hydrocracking catalyst, the amount of that hydrogenation metal can be at least about 0.1 wt % based on the total weight of the catalyst, for example at least about 0.5 wt % or at least about 0.6 wt %. Additionally or alternately when only one hydrogenation metal is present, the amount of that hydrogenation metal can be about 5.0 wt % or less based on the total weight of the catalyst, for example about 3.5 wt % or less, about 2.5 wt % or less, about 1.5 wt % or less, about 1.0 wt % or less, about 0.9 wt % or less, about 0.75 wt % or less, or about 0.6 wt % or less. Further additionally or alternately when more than one hydrogenation metal is present, the collective amount of hydrogenation metals can be at least about 0.1 wt % based on the total weight of the catalyst, for example at least about 0.25 wt %, at least about 0.5 wt %, at least about 0.6 wt %, at least about 0.75 wt %, or at least about 1 wt %. Still further additionally or alternately when more than one hydrogenation metal is present, the collective amount of hydrogenation metals can be about 35 wt % or less based on the total weight of the catalyst, for example about 30 wt % or less, about 25 wt % or less, about 20 wt % or less, about 15 wt % or less, about 10 wt % or less, or about 5 wt % or less. In embodiments wherein the supported metal comprises a noble metal, the amount of noble metal(s) is typically less than about 2 wt %, for example less than about 1 wt %, about 0.9 wt % or less, about 0.75 wt % or less, or about 0.6 wt % or less. It is noted that hydrocracking under sour conditions is typically performed using a base metal (or metals) as the hydrogenation metal.

In various aspects, the conditions selected for hydrocracking for lubricant base stock production can depend on the desired level of conversion, the level of contaminants in the input feed to the hydrocracking stage, and potentially other factors. For example, hydrocracking conditions in a single stage, or in the first stage and/or the second stage of a multi-stage system, can be selected to achieve a desired level of conversion in the reaction system. Hydrocracking conditions can be referred to as sour conditions or sweet conditions, depending on the level of sulfur and/or nitrogen present within a feed. For example, a feed with 100 wppm or less of sulfur and 50 wppm or less of nitrogen, preferably less than 25 wppm sulfur and/or less than 10 wppm of nitrogen, represent a feed for hydrocracking under sweet conditions. In various aspects, hydrocracking can be performed on a thermally cracked resid, such as a deasphalted oil derived from a thermally cracked resid. In some aspects, such as aspects where an optional hydrotreating step is used prior to hydrocracking, the thermally cracked resid may correspond to a sweet feed. In other aspects, the thermally cracked resid may represent a feed for hydrocracking under sour conditions.

A hydrocracking process under sour conditions can be carried out at temperatures of about 550° F. (288° C.) to about 840° F. (449° C.), hydrogen partial pressures of from about 1500 psig to about 5000 psig (10.3 MPag to 34.6 MPag), liquid hourly space velocities of from 0.05 to 10 and hydrogen treat gas rates of from 35.6 $m^3/m^3$ to 1781 $m^3/m^3$ (200 SCF/B to 10,000 SCF/B). In other embodiments, the conditions can include temperatures in the range of about 600° F. (343° C.) to about 815° F. (435° C.), hydrogen partial pressures of from about 1500 psig to about 3000 psig (10.3 MPag-20.9 MPag), and hydrogen treat gas rates of from about 213 $m^3/m^3$ to about 1068 $m^3/m^3$ (1200 SCF/B to 6000 SCF/B). The LHSV can be from about 0.25 to about 50 or from about 0.5 $h^{-1}$ to about 20 $h^{-1}$, preferably from about 1.0 $h^{-1}$ to about 4.0 $h^{-1}$.

In some aspects, a portion of the hydrocracking catalyst can be contained in a second reactor stage. In such aspects, a first reaction stage of the hydroprocessing reaction system can include one or more hydrotreating and/or hydrocracking catalysts. The conditions in the first reaction stage can be suitable for reducing the sulfur and/or nitrogen content of the feedstock. A separator can then be used in between the first and second stages of the reaction system to remove gas phase sulfur and nitrogen contaminants. One option for the separator is to simply perform a gas-liquid separation to remove contaminant. Another option is to use a separator such as a flash separator that can perform a separation at a higher temperature. Such a high temperature separator can be used, for example, to separate the feed into a portion boiling below a temperature cut point, such as about 350° F. (177° C.) or about 400° F. (204° C.), and a portion boiling above the temperature cut point. In this type of separation, the naphtha boiling range portion of the effluent from the first reaction stage can also be removed, thus reducing the volume of effluent that is processed in the second or other subsequent stages. Of course, any low boiling contaminants in the effluent from the first stage would also be separated into the portion boiling below the temperature cut point. If sufficient contaminant removal is performed in the first stage, the second stage can be operated as a "sweet" or low contaminant stage.

Still another option can be to use a separator between the first and second stages of the hydroprocessing reaction system that can also perform at least a partial fractionation of the effluent from the first stage. In this type of aspect, the effluent from the first hydroprocessing stage can be separated into at least a portion boiling below the distillate (such as diesel) fuel range, a portion boiling in the distillate fuel range, and a portion boiling above the distillate fuel range.

The distillate fuel range can be defined based on a conventional diesel boiling range, such as having a lower end cut point temperature of at least about 350° F. (177° C.) or at least about 400° F. (204° C.) to having an upper end cut point temperature of about 700° F. (371° C.) or less or 650° F. (343° C.) or less. Optionally, the distillate fuel range can be extended to include additional kerosene, such as by selecting a lower end cut point temperature of at least about 300° F. (149° C.).

In aspects where the inter-stage separator is also used to produce a distillate fuel fraction, the portion boiling below the distillate fuel fraction includes, naphtha boiling range molecules, light ends, and contaminants such as $H_2S$. These different products can be separated from each other in any convenient manner. Similarly, one or more distillate fuel fractions can be formed, if desired, from the distillate boiling range fraction. The portion boiling above the distillate fuel range represents the potential lubricant base stocks. In such aspects, the portion boiling above the distillate fuel range is subjected to further hydroprocessing in a second hydroprocessing stage.

A hydrocracking process under sweet conditions can be performed under conditions similar to those used for a sour hydrocracking process, or the conditions can be different. In an embodiment, the conditions in a sweet hydrocracking stage can have less severe conditions than a hydrocracking process in a sour stage. Suitable hydrocracking conditions for a non-sour stage can include, but are not limited to, conditions similar to a first or sour stage. Suitable hydrocracking conditions can include temperatures of about 500° F. (260° C.) to about 840° F. (449° C.), hydrogen partial pressures of from about 1500 psig to about 5000 psig (10.3 MPag to 34.6 MPag), liquid hourly space velocities of from 0.05 $h^{-1}$ to 10 $h^{-1}$, and hydrogen treat gas rates of from 35.6 $m^3/m^3$ to 1781 $m^3/m^3$ (200 SCF/B to 10,000 SCF/B). In other embodiments, the conditions can include temperatures in the range of about 600° F. (343° C.) to about 815° F. (435° C.), hydrogen partial pressures of from about 1500 psig to about 3000 psig (10.3 MPag-20.9 MPag), and hydrogen treat gas rates of from about 213 $m^3/m^3$ to about 1068 $m^3/m^3$ (1200 SCF/B to 6000 SCF/B). The LHSV can be from about 0.25 to about 50 or from about 0.5 to about 20 preferably from about 1.0 $h^{-1}$ to about 4.0 $h^{-1}$.

In still another aspect, the same conditions can be used for hydrotreating and hydrocracking beds or stages, such as using hydrotreating conditions for both or using hydrocracking conditions for both. In yet another embodiment, the pressure for the hydrotreating and hydrocracking beds or stages can be the same.

In yet another aspect, a hydroprocessing reaction system may include more than one hydrocracking stage. If multiple hydrocracking stages are present, at least one hydrocracking stage can have effective hydrocracking conditions as described above, including a hydrogen partial pressure of at least about 1500 psig (10.3 MPag). In such an aspect, other hydrocracking processes can be performed under conditions that may include lower hydrogen partial pressures. Suitable hydrocracking conditions for an additional hydrocracking stage can include, but are not limited to, temperatures of about 500° F. (260° C.) to about 840° F. (449° C.), hydrogen partial pressures of from about 250 psig to about 5000 psig (1.8 MPag to 34.6 MPag), liquid hourly space velocities of from 0.05 $h^{-1}$ to 10 $h^{-1}$, and hydrogen treat gas rates of from 35.6 $m^3/m^3$ to 1781 $m^3/m^3$ (200 SCF/B to 10,000 SCF/B). In other embodiments, the conditions for an additional hydrocracking stage can include temperatures in the range of about 600° F. (343° C.) to about 815° F. (435° C.), hydrogen partial pressures of from about 500 psig to about 3000 psig (3.5 MPag-20.9 MPag), and hydrogen treat gas rates of from about 213 $m^3/m^3$ to about 1068 $m^3/m^3$ (1200 SCF/B to 6000 SCF/B). The LHSV can be from about 0.25 $h^{-1}$ to about 50 $h^{-1}$, or from about 0.5 $h^{-1}$ to about 20 $h^{-1}$, and preferably from about 1.0 $h^{-1}$ to about 4.0 $h^{-1}$.

Additional Hydroprocessing—Catalytic Dewaxing, Hydrofinishing, and Optional Hydrocracking In various aspects, at least a lubricant boiling range portion of the hydroprocessed deasphalted oil can be exposed to further hydroprocessing (including catalytic dewaxing) to form lubricant base stocks, including Group II and/or Group III heavy neutral base stock and/or bright stock. Optionally, the further hydroprocessing of the lubricant boiling range portion of the hydroprocessed deasphalted oil can also include exposure to hydrocracking conditions before and/or after the exposure to the catalytic dewaxing conditions. As noted above, at this point in the process, the hydrocracking can be considered "sweet" hydrocracking, as the hydroprocessed deasphalted oil can have a sulfur content of 200 wppm or less.

Suitable hydrocracking conditions can include exposing the feed to a hydrocracking catalyst as previously described above. Optionally, it can be preferable to use a USY zeolite with a silica to alumina ratio of at least 30 and a unit cell size of less than 24.32 Angstroms as the zeolite for the hydrocracking catalyst, in order to improve the VI uplift from hydrocracking and/or to improve the ratio of distillate fuel yield to naphtha fuel yield in the fuels boiling range product.

Suitable hydrocracking conditions can also include temperatures of about 500° F. (260° C.) to about 840° F. (449° C.), hydrogen partial pressures of from about 1500 psig to about 5000 psig (10.3 MPag to 34.6 MPag), liquid hourly space velocities of from 0.05 $h^{-1}$ to 10 $h^{-1}$, and hydrogen treat gas rates of from 35.6 $m^3/m^3$ to 1781 $m^3/m^3$ (200 SCF/B to 10,000 SCF/B). In other embodiments, the conditions can include temperatures in the range of about 600° F. (343° C.) to about 815° F. (435° C.), hydrogen partial pressures of from about 1500 psig to about 3000 psig (10.3 MPag-20.9 MPag), and hydrogen treat gas rates of from about 213 $m^3/m^3$ to about 1068 $m^3/m^3$ (1200 SCF/B to 6000 SCF/B). The LHSV can be from about 0.25 $h^{-1}$ to about 50 $h^{-1}$, or from about 0.5 $h^{-1}$ to about 20 $h^{-1}$, and preferably from about 1.0 $h^{-1}$ to about 4.0 $h^{-1}$.

For catalytic dewaxing, suitable dewaxing catalysts can include molecular sieves such as crystalline aluminosilicates (zeolites). In an embodiment, the molecular sieve can comprise, consist essentially of, or be ZSM-22, ZSM-23, ZSM-48. Optionally but preferably, molecular sieves that are selective for dewaxing by isomerization as opposed to cracking can be used, such as ZSM-48, ZSM-23, or a combination thereof. Additionally or alternately, the molecular sieve can comprise, consist essentially of, or be a 10-member ring 1-D molecular sieve, such as EU-2, EU-11, ZBM-30, ZSM-48, or ZSM-23. ZSM-48 is most preferred. Note that a zeolite having the ZSM-23 structure with a silica to alumina ratio of from about 20:1 to about 40:1 can sometimes be referred to as SSZ-32. Optionally but preferably, the dewaxing catalyst can include a binder for the molecular sieve, such as alumina, titania, silica, silica-alumina, zirconia, or a combination thereof, for example alumina and/or titania or silica and/or zirconia and/or titania.

Preferably, the dewaxing catalysts used in processes according to the invention are catalysts with a low ratio of silica to alumina. For example, for ZSM-48, the ratio of silica to alumina in the zeolite can be about 100:1 or less, such as about 90:1 or less, or about 75:1 or less, or about 70:1 or less. Additionally or alternately, the ratio of silica to alumina in the ZSM-48 can be at least about 50:1, such as at least about 60:1, or at least about 65:1.

In various embodiments, the catalysts according to the invention further include a metal hydrogenation component. The metal hydrogenation component is typically a Group VI and/or a Group VIII metal. Preferably, the metal hydrogenation component can be a combination of a non-noble Group VIII metal with a Group VI metal. Suitable combinations can include Ni, Co, or Fe with Mo or W, preferably Ni with Mo or W.

The metal hydrogenation component may be added to the catalyst in any convenient manner. One technique for adding the metal hydrogenation component is by incipient wetness. For example, after combining a zeolite and a binder, the combined zeolite and binder can be extruded into catalyst particles. These catalyst particles can then be exposed to a solution containing a suitable metal precursor. Alternatively, metal can be added to the catalyst by ion exchange, where a metal precursor is added to a mixture of zeolite (or zeolite and binder) prior to extrusion.

The amount of metal in the catalyst can be at least 0.1 wt % based on catalyst, or at least 0.5 wt %, or at least 1.0 wt %, or at least 2.5 wt %, or at least 5.0 wt %, based on catalyst. The amount of metal in the catalyst can be 20 wt % or less based on catalyst, or 10 wt % or less, or 5 wt % or less, or 2.5 wt % or less, or 1 wt % or less. For embodiments where the metal is a combination of a non-noble Group VIII metal with a Group VI metal, the combined amount of metal can be from 0.5 wt % to 20 wt %, or 1 wt % to 15 wt %, or 2.5 wt % to 10 wt %.

The dewaxing catalysts useful in processes according to the invention can also include a binder. In some embodiments, the dewaxing catalysts used in process according to the invention are formulated using a low surface area binder, a low surface area binder represents a binder with a surface area of 100 $m^2/g$ or less, or 80 $m^2/g$ or less, or 70 $m^2/g$ or less. Additionally or alternately, the binder can have a surface area of at least about 25 $m^2/g$. The amount of zeolite in a catalyst formulated using a binder can be from about 30 wt % zeolite to 90 wt % zeolite relative to the combined weight of binder and zeolite. Preferably, the amount of zeolite is at least about 50 wt % of the combined weight of zeolite and binder, such as at least about 60 wt % or from about 65 wt % to about 80 wt %.

Without being bound by any particular theory, it is believed that use of a low surface area binder reduces the amount of binder surface area available for the hydrogenation metals supported on the catalyst. This leads to an increase in the amount of hydrogenation metals that are supported within the pores of the molecular sieve in the catalyst.

A zeolite can be combined with binder in any convenient manner. For example, a bound catalyst can be produced by starting with powders of both the zeolite and binder, combining and mulling the powders with added water to form a mixture, and then extruding the mixture to produce a bound catalyst of a desired size. Extrusion aids can also be used to modify the extrusion flow properties of the zeolite and binder mixture. The amount of framework alumina in the catalyst may range from 0.1 to 3.33 wt %, or 0.1 to 2.7 wt %, or 0.2 to 2 wt %, or 0.3 to 1 wt %.

Effective conditions for catalytic dewaxing of a feedstock in the presence of a dewaxing catalyst can include a temperature of from 280° C. to 450° C., preferably 343° C. to 435° C., a hydrogen partial pressure of from 3.5 MPag to 34.6 MPag (500 psig to 5000 psig), preferably 4.8 MPag to 20.8 MPag, and a hydrogen circulation rate of from 178 $m^3/m^3$ (1000 SCF/B) to 1781 $m^3/m^3$ (10,000 scf/B), preferably 213 $m^3/m^3$ (1200 SCF/B) to 1068 $m^3/m^3$ (6000 SCF/B). The LHSV can be from about 0.2 $h^{-1}$ to about 10 $h^{-1}$, such as from about 0.5 $h^{-1}$ to about 5 $h^{-1}$ and/or from about 1 $h^{-1}$ to about 4 $h^{-1}$.

Before and/or after catalytic dewaxing, the hydroprocessed deasphalted oil (i.e., at least a lubricant boiling range portion thereof) can optionally be exposed to an aromatic saturation catalyst, which can alternatively be referred to as a hydrofinishing catalyst. Exposure to the aromatic saturation catalyst can occur either before or after fractionation. If aromatic saturation occurs after fractionation, the aromatic saturation can be performed on one or more portions of the fractionated product. Alternatively, the entire effluent from the last hydrocracking or dewaxing process can be hydrofinished and/or undergo aromatic saturation.

Hydrofinishing and/or aromatic saturation catalysts can include catalysts containing Group VI metals, Group VIII metals, and mixtures thereof. In an embodiment, preferred metals include at least one metal sulfide having a strong hydrogenation function. In another embodiment, the hydrofinishing catalyst can include a Group VIII noble metal, such as Pt, Pd, or a combination thereof. The mixture of metals may also be present as bulk metal catalysts wherein the amount of metal is about 30 wt. % or greater based on catalyst. For supported hydrotreating catalysts, suitable metal oxide supports include low acidic oxides such as silica, alumina, silica-aluminas or titania, preferably alumina. The preferred hydrofinishing catalysts for aromatic saturation will comprise at least one metal having relatively strong hydrogenation function on a porous support. Typical support materials include amorphous or crystalline oxide materials such as alumina, silica, and silica-alumina. The support materials may also be modified, such as by halogenation, or in particular fluorination. The metal content of the catalyst is often as high as about 20 weight percent for non-noble metals. In an embodiment, a preferred hydrofinishing catalyst can include a crystalline material belonging to the M41S class or family of catalysts. The M41S family of catalysts are mesoporous materials having high silica content. Examples include MCM-41, MCM-48 and MCM-50. A preferred member of this class is MCM-41.

Hydrofinishing conditions can include temperatures from about 125° C. to about 425° C., preferably about 180° C. to about 280° C., a hydrogen partial pressure from about 500 psig (3.4 MPa) to about 3000 psig (20.7 MPa), preferably about 1500 psig (10.3 MPa) to about 2500 psig (17.2 MPa), and liquid hourly space velocity from about 0.1 $hr^{-1}$ to about 5 $hr^{-1}$ LHSV, preferably about 0.5 $hr^{-1}$ to about 1.5 $hr^{-1}$. Additionally, a hydrogen treat gas rate of from 35.6 $m^3/m^3$ to 1781 $m^3/m^3$ (200 SCF/B to 10,000 SCF/B) can be used.

Group II Bright Stock Products

For deasphalted oils derived from propane, butane, pentane, hexane and higher or mixtures thereof, the further hydroprocessing (including catalytic dewaxing) and potentially solvent processing can be sufficient to form lubricant base stocks with low haze formation (or no haze formation) and novel compositional properties. Traditional products manufactured today with kinematic viscosity of about 32 cSt at 100° C. contain aromatics that are >10% and/or sulfur that is >0.03% of the base oil.

In some aspects, base stocks produced according to methods described herein can have a kinematic viscosity of at least 14 cSt, or at least 20 cSt, or at least 25 cSt, or at least 30 cSt, or at least 32 cSt at 100° C. and can contain less than 10 wt % aromatics/greater than 90 wt % saturates and less than 0.03% sulfur. Optionally, the saturates content can be still higher, such as greater than 95 wt %, or greater than 97 wt %. In addition, detailed characterization of the branchiness (branching) of the molecules by C-NMR reveals a high degree of branch points as described further below in the examples. This can be quantified by examining the absolute number of methyl branches, or ethyl branches, or propyl branches individually or as combinations thereof. This can also be quantified by looking at the ratio of branch points (methyl, ethyl, or propyl) compared to the number of internal carbons, labeled as epsilon carbons by C-NMR. This quantification of branching can be used to determine whether a base stock will be stable against haze formation over time. For $^{13}$C-NMR results reported herein, samples were prepared to be 25-30 wt % in $CDCl_3$ with 7% Chromium (III)-acetylacetonate added as a relaxation agent. $^{13}$C NMR experiments were performed on a JEOL ECS NMR spectrometer for which the proton resonance frequency is 400 MHz. Quantitative $^{13}$C NMR experiments were performed at 27° C. using an inverse gated decoupling experiment with a 45° flip angle, 6.6 seconds between pulses, 64 K data points and 2400 scans. All spectra were referenced to TMS at 0 ppm. Spectra were processed with 0.2-1 Hz of line broadening and baseline correction was applied prior to manual integration. The entire spectrum was integrated to determine the mole % of the different integrated areas as follows: 170-190 PPM (aromatic C); 30-29.5 PPM (epsilon carbons); 15-14.5 PPM (terminal and pendant propyl groups) 14.5-14 PPM—Methyl at the end of a long chain (alpha); 12-10 PPM (pendant and terminal ethyl groups). Total methyl content was obtained from proton NMR. The methyl signal at 0-1.1 PPM was integrated. The entire spectrum was integrated to determine the mole % of methyls. Average carbon numbers obtained from gas chromatography were used to convert mole % methyls to total methyls.

Also unexpected in the composition is the discovery using Fourier Transform Ion Cyclotron Resonance-Mass Spectrometry (FTICR-MS) and/or Field Desorption Mass Spectrometry (FDMS) that the prevalence of smaller naphthenic ring structures below 6 or below 7 or below 8 naphthene rings can be similar but the residual numbers of larger naphthenic ring structures with 7 or more rings or 8+ rings or 9+ rings or 10+ rings is diminished in base stocks that are stable against haze formation.

For FTICR-MS results reported herein, the results were generated according to the method described in U.S. Pat. No. 9,418,828. The method described in U.S. Pat. No. 9,418,828 generally involves using laser desorption with Ag ion complexation (LDI-Ag) to ionize petroleum saturates molecules (including 538° C.+ molecules) without fragmentation of the molecular ion structure. Ultra-high resolution Fourier Transform Ion Cyclotron Resonance Mass Spectrometry is applied to determine exact elemental formula of the saturates-Ag cations and corresponding abundances. The saturates fraction composition can be arranged by homologous series and molecular weights. The portion of U.S. Pat. No. 9,418,828 related to determining the content of saturate ring structures in a sample is incorporated herein by reference.

For FDMS results reported herein, Field desorption (FD) is a soft ionization method in which a high-potential electric field is applied to an emitter (a filament from which tiny "whiskers" have formed) that has been coated with a diluted sample resulting in the ionization of gaseous molecules of the analyte. Mass spectra produced by FD are dominated by molecular radical cations $M^+$ or in some cases protonated molecular ions $[M+H]^+$. Because FDMS cannot distinguish between molecules with 'n' naphthene rings and molecules with 'n+7' rings, the FDMS data was "corrected" by using the FTICR-MS data from the most similar sample. The FDMS correction was performed by applying the resolved ratio of "n" to "n+7" rings from the FTICR-MS to the unresolved FDMS data for that particular class of molecules. Hence, the FDMS data is shown as "corrected" in the figures.

Base oils of the compositions described above have further been found to provide the advantage of being haze free upon initial production and remaining haze free for extended periods of time. This is an advantage over the prior art of high saturates heavy base stocks that was unexpected.

Additionally, it has been found that these base stocks can be blended with additives to form formulated lubricants, such as but not limited to marine oils, engine oils, greases, paper machine oils, and gear oils. These additives may include, but are not restricted to, detergents, dispersants, antioxidants, viscosity modifiers, and pour point depressants. More generally, a formulated lubricating including a base stock produced from a deasphalted oil may additionally contain one or more of the other commonly used lubricating oil performance additives including but not limited to anti-wear agents, dispersants, other detergents, corrosion inhibitors, rust inhibitors, metal deactivators, extreme pressure additives, anti-seizure agents, wax modifiers, viscosity index improvers, viscosity modifiers, fluid-loss additives, seal compatibility agents, friction modifiers, lubricity agents, anti-staining agents, chromophoric agents, defoamants, demulsifiers, emulsifiers, densifiers, wetting agents, gelling agents, tackiness agents, colorants, and others. For a review of many commonly used additives, see Klamann in Lubricants and Related Products, Verlag Chemie, Deerfield Beach, Fla.; ISBN 0-89573-177-0. These additives are commonly delivered with varying amounts of diluent oil, that may range from 5 weight percent to 50 weight percent.

When so blended, the performance as measured by standard low temperature tests such as the Mini-Rotary Viscometer (MRV) and Brookfield test has been shown to be superior to formulations blended with traditional base oils.

It has also been found that the oxidation performance, when blended into industrial oils using common additives such as, but not restricted to, defoamants, pour point depressants, antioxidants, rust inhibitors, has exemplified superior oxidation performance in standard oxidation tests such as the US Steel Oxidation test compared to traditional base stocks.

Other performance parameters such as interfacial properties, deposit control, storage stability, and toxicity have also been examined and are similar to or better than traditional base oils.

In addition to being blended with additives, the base stocks described herein can also be blended with other base stocks to make a base oil. These other base stocks include solvent processed base stocks, hydroprocessed base stocks, synthetic base stocks, base stocks derived from Fisher-Tropsch processes, PAO, and naphthenic base stocks. Additionally or alternately, the other base stocks can include Group I base stocks, Group II base stocks, Group III base stocks, Group IV base stocks, and/or Group V base stocks. Additionally or alternately, still other types of base stocks for blending can include hydrocarbyl aromatics, alkylated aromatics, esters (including synthetic and/or renewable esters), and or other non-conventional or unconventional base stocks. These base oil blends of the inventive base stock and other base stocks can also be combined with additives, such as those mentioned above, to make formulated lubricants.

CONFIGURATION EXAMPLES

Figure 2:
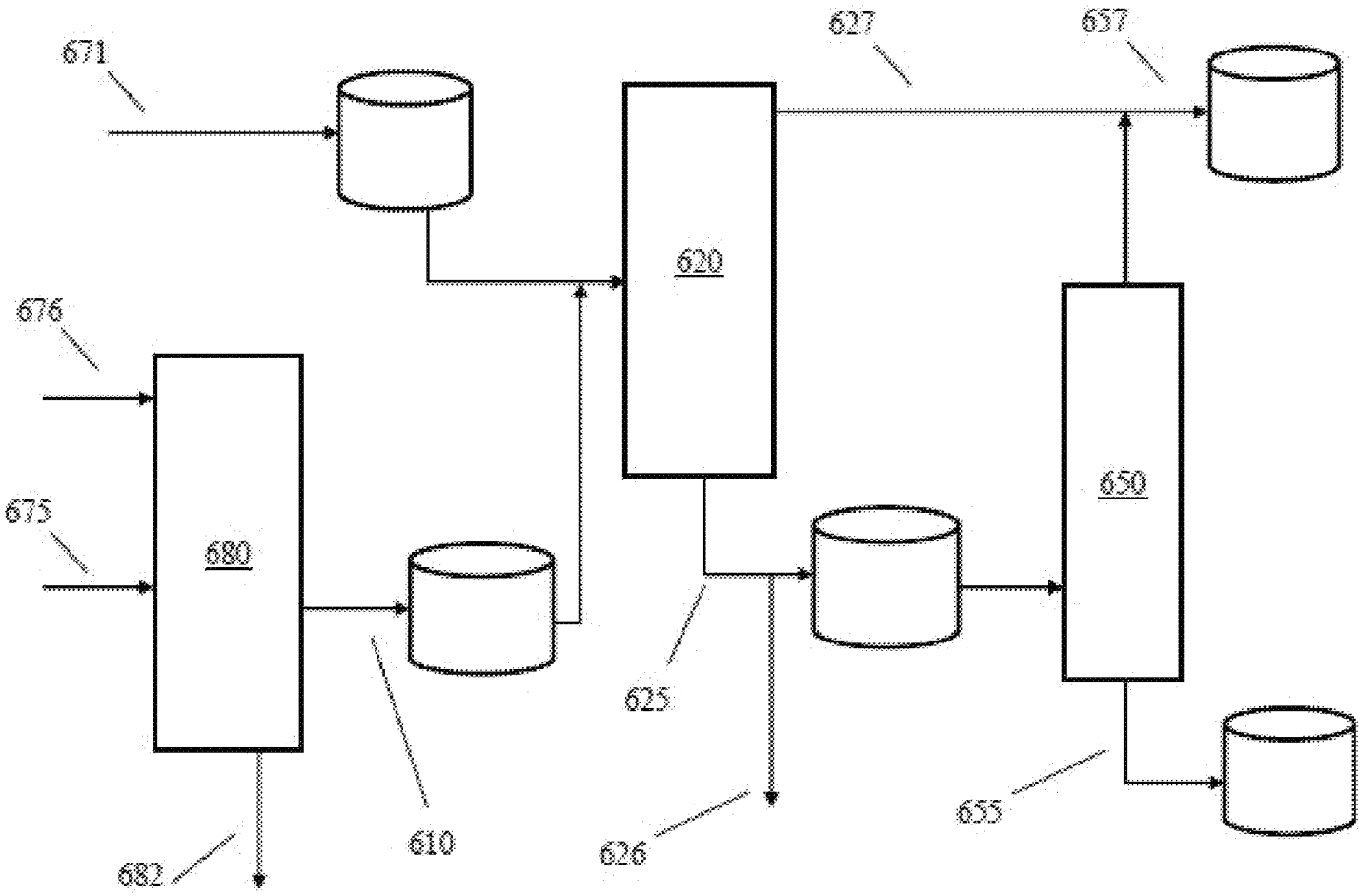
FIG. 2 schematically shows an example of a configuration for catalytic processing of deasphalted oil to form lubricant base stocks.

FIG. 2 schematically shows a configuration for producing base stocks from a deasphalted oil feed, possibly including a heavy neutral base stock and/or a bright stock. The configuration shown in FIG. 2 represents the sour hydroprocessing stage 620 and the sweet hydroprocessing stage 650 as single elements, but it is understood that these stages can include any convenient number of reactors and/or catalysts. In FIG. 2, a vacuum resid feed 675 and a deasphalting solvent 676 are passed into a deasphalting unit 680. In some aspects, a $C_{4+}$ solvent can be used. Deasphalting unit 680 can produce a rock or asphalt fraction 682 and a deasphalted oil 610. Optionally, deasphalted oil 610 can be combined with another vacuum gas oil boiling range feed 671 prior to being introduced into first (sour) hydroprocessing stage 620. A lower boiling portion 627 of the effluent from hydroprocessing stage 620 can be separated out for further use and/or processing as one or more naphtha fractions and/or distillate fractions. A higher boiling portion 625 of the hydroprocessing effluent can be a) passed into a second (sweet) hydroprocessing stage 650 and/or b) withdrawn 626 from the processing system for use as a fuel, such as a fuel oil or fuel oil blendstock. Second hydroprocessing stage 650 can produce an effluent that can be separated to form one or more fuels fractions 657 and one or more lubricant base stock fractions 655, such as one or more bright stock fractions. It is noted that the sample configuration shown in FIG. 1 can correspond to a second hydroprocessing stage 650.

Figure 3:
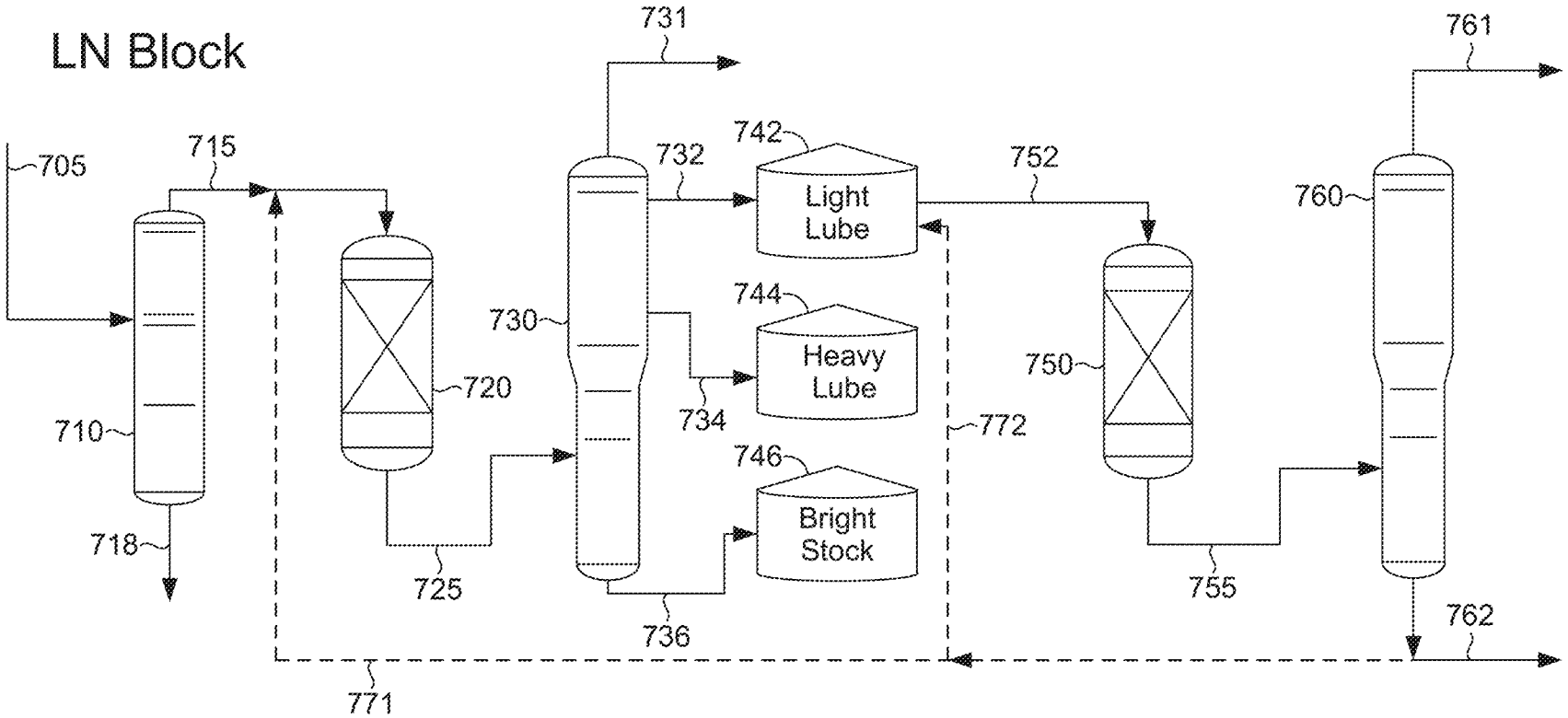
FIG. 3 schematically shows an example of a configuration for block catalytic processing of deasphalted oil to form lubricant base stocks.
Figure 4:
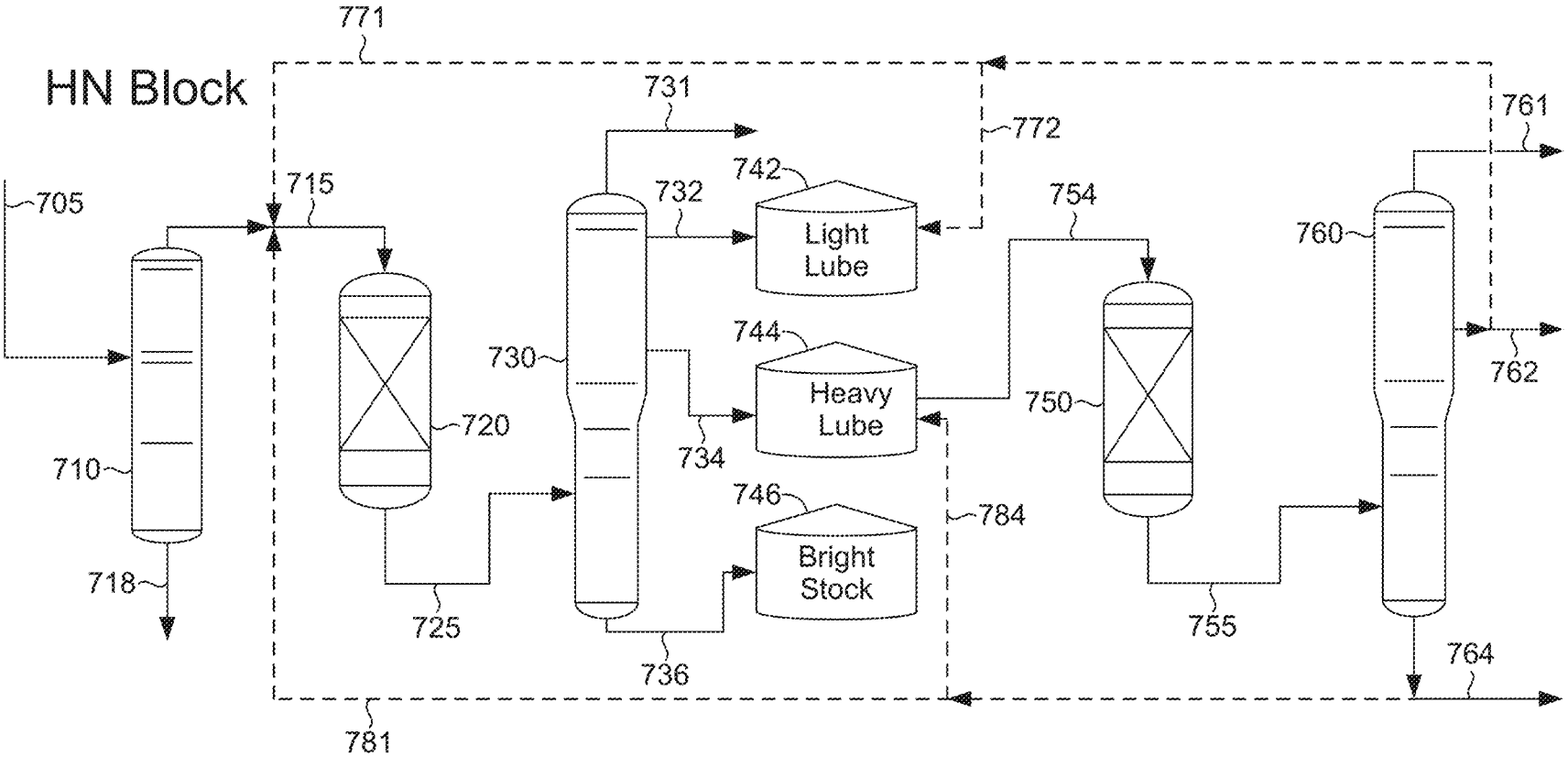
FIG. 4 schematically shows an example of a configuration for block catalytic processing of deasphalted oil to form lubricant base stocks.
Figure 5:
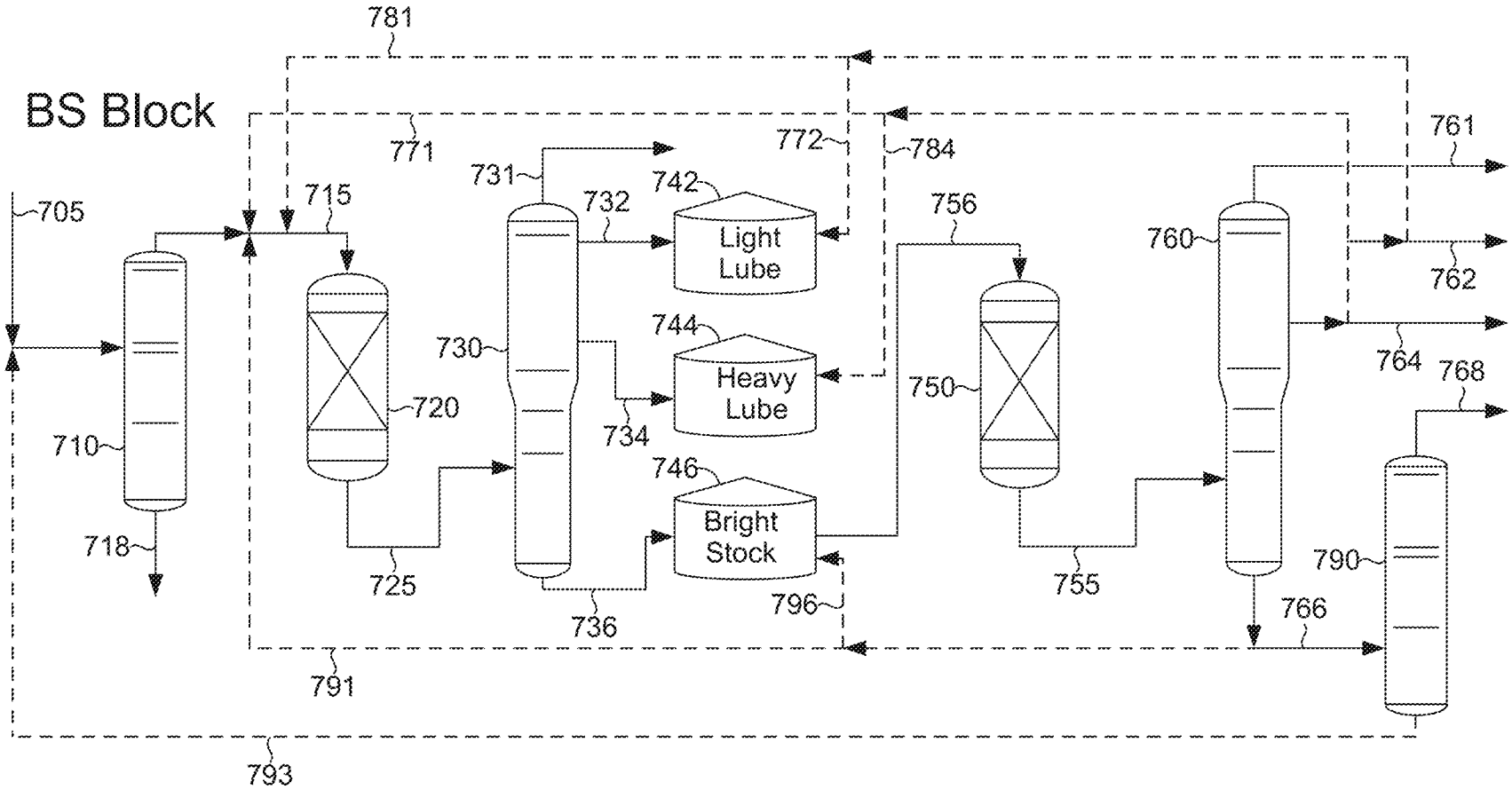
FIG. 5 schematically shows an example of a configuration for block catalytic processing of deasphalted oil to form lubricant base stocks.

FIGS. 3 to 5 show examples of using blocked operation and/or partial product recycle during lubricant production based on a feed including deasphalted resid. In FIGS. 3 to 5, after initial sour stage processing, the hydroprocessed effluent is fractionated to form light neutral, heavy neutral, and bright stock portions. FIG. 3 shows an example of the process flow during processing to form light neutral base stock. FIG. 4 shows an example of the process flow during processing to form heavy neutral base stock. FIG. 5 shows an example of the process flow during processing to form bright stock.

In FIG. 3, a feed 705 is introduced into a deasphalter 710. The deasphalter 710 generates a deasphalted oil 715 and deasphalter rock or residue 718. The deasphalted oil 715 is then processed in a sour processing stage 720. Optionally, a portion 771 of recycled light neutral base product 762 can be combined with deasphalted oil 715. Sour processing stage 720 can include one or more of a deasphalting catalyst, a hydrotreating catalyst, a hydrocracking catalyst, and/or an aromatic saturation catalyst. The conditions in sour processing stage 720 can be selected to at least reduce the sulfur content of the hydroprocessed effluent 725 to 20 wppm or less. This can correspond to 15 wt % to 40 wt % conversion of the feed relative to 370° C. Optionally, the amount of conversion in the sour processing stage 720 can be any convenient higher amount so long as the combined conversion in sour processing stage 720 and sweet processing stage 750 is 90 wt % or less.

The hydroprocessed effluent 725 can then be passed into fractionation stage 730 for separation into a plurality of fractions. In the example shown in FIG. 11, the hydroprocessed effluent is separated into a light neutral portion 732, a heavy neutral portion 734, and a bright stock portion 736. To allow for blocked operation, the light neutral portion 732 can be sent to corresponding light neutral storage 742, the heavy neutral portion 734 can be sent to corresponding heavy neutral storage 744, and the bright stock portion 736 can be sent to corresponding bright stock storage 746. A lower boiling range fraction 731 corresponding to fuels and/or light ends can also be generated by fractionation stage 730. Optionally, fractionation stage can generate a plurality of lower boiling range fractions 731.

FIG. 3 shows an example of the processing system during a light neutral processing block. In FIG. 3, the feed 752 to sweet processing stage 750 corresponds to a feed derived from light neutral storage 742. The sweet processing stage 750 can include at least dewaxing catalyst, and optionally can further include one or more of hydrocracking catalyst and aromatics saturation catalyst. The dewaxed effluent 755 from sweet processing stage 750 can then be passed into a fractionator 760 to form light neutral base stock product 762. A lower boiling fraction 761 corresponding to fuels and/or light ends can also be separated out by fractionator 760. Optionally, a portion of light neutral base stock 762 can be recycled. The recycled portion of light neutral base stock 762 can be used as a recycled feed portion 771 and/or as a recycled portion 772 that is added to light neutral storage 742. Recycling a portion 771 for use as part of the feed can be beneficial for increasing the lifetime of the catalysts in sour processing stage 720. Recycling a portion 772 to light neutral storage 742 can be beneficial for increasing conversion and/or VI.

FIG. 4 shows the same processing configuration during processing of a heavy neutral block. In FIG. 12, the feed 754 to sweet processing stage 750 is derived from heavy neutral storage 744. The dewaxed effluent 755 from sweet processing stage 750 can be fractionated 760 to form lower boiling portion 761, heavy neutral base stock product 764, and light neutral base stock product 762. Because block operation to form a heavy neutral base stock results in production of both a light neutral product 762 and a heavy neutral product 764, various optional recycle streams can also be used. In the example shown in FIG. 12, optional recycle portions 771 and 772 can be used for recycle of the light neutral product 762. Additionally, optional recycle portions 781 and 784 can be used for recycle of the heavy neutral product 764. Recycle portions 781 and 784 can provide similar benefits to those for recycle portions 771 and/or 772.

It is noted that the sample configuration shown in FIG. 1 can correspond to a second or sweet hydroprocessing stage 750 in FIG. 4. In addition to recycling of portions of base stock fractions, a portion of the fuels fraction 761 can potentially also be suitable for recycle. For example, a distillate fuel boiling range portion of fuels fraction 761 can be recycled 767 for use as a solvent or diluent to facilitate exposing the (partially) hydroprocessed effluent to an adsorbent.

FIG. 5 shows the same processing configuration during processing of a bright stock block. In FIG. 5, the feed 756 to sweet processing stage 750 is derived from bright stock storage 746. The dewaxed effluent 755 from sweet processing stage 750 can be fractionated 760 to form lower boiling portion 761, bottoms product 766, heavy neutral base stock product 764, and light neutral base stock product 762. Bottoms product 766 can then be extracted 790 to form a bright stock product 768. The aromatic extract 793 produced in extractor 790 can be recycled for use, for example, as part of the feed to deasphalter 710.

Because block operation to form a bright stock results in production of a bright stock product 768 as well as a light neutral product 762 and a heavy neutral product 764, various optional recycle streams can also be used. In the example shown in FIG. 13, optional recycle portions 771 and 772 can be used for recycle of the light neutral product 762, while optional recycle portions 781 and 784 can be used for recycle of the heavy neutral product 764. Additionally, optional recycle portions 791 and 796 can be used for recycle of the bottoms product 766. Recycle portions 791 and 796 can provide similar benefits to those for recycle portions 771, 772, 781, and/or 784.

It is noted that the sample configuration shown in FIG. 1 can correspond to a second or sweet hydroprocessing stage 750 in FIG. 5. In addition to recycling of portions of base stock fractions, a portion of the fuels fraction 761 can potentially also be suitable for recycle. For example, a distillate fuel boiling range portion of fuels fraction 761 can be recycled 767 for use as a solvent or diluent to facilitate exposing the (partially) hydroprocessed effluent to an adsorbent.

Lubricating Oil Additives

A formulated lubricating oil useful in the present disclosure may contain one or more of the other commonly used lubricating oil performance additives including but not limited to antiwear additives, detergents, dispersants, viscosity modifiers, corrosion inhibitors, rust inhibitors, metal deactivators, extreme pressure additives, anti-seizure agents, wax modifiers, other viscosity modifiers, fluid-loss additives, seal compatibility agents, lubricity agents, anti-staining agents, chromophoric agents, defoamants, demulsifiers, emulsifiers, densifiers, wetting agents, gelling agents, tackiness agents, colorants, and others. For a review of many commonly used additives, see "Lubricant Additives, Chemistry and Applications", Ed. L. R. Rudnick, Marcel Dekker, Inc. 270 Madison Ave. New York, N.J. 10016, 2003, and Klamann in Lubricants and Related Products, Verlag Chemie, Deerfield Beach, Fla.; ISBN 0-89573-177-0. Reference is also made to "Lubricant Additives" by M. W. Ranney, published by Noyes Data Corporation of Parkridge, N J (1973); see also U.S. Pat. No. 7,704,930, the disclosure of which is incorporated herein in its entirety. These additives are commonly delivered with varying amounts of diluent oil that may range from 5 weight percent to 50 weight percent.

The additives useful in this disclosure do not have to be soluble in the lubricating oils. Insoluble additives such as zinc stearate in oil can be dispersed in the lubricating oils of this disclosure.

When lubricating oil compositions contain one or more additives, the additive(s) are blended into the composition in an amount sufficient for it to perform its intended function. Additives are typically present in lubricating oil compositions as a minor component, typically in an amount of less than 50 weight percent, preferably less than about 30 weight percent, and more preferably less than about 15 weight percent, based on the total weight of the composition. Additives are most often added to lubricating oil compositions in an amount of at least 0.1 weight percent, preferably at least 1 weight percent, more preferably at least 5 weight percent. Typical amounts of such additives useful in the present disclosure are shown in Table 1 below.

It is noted that many of the additives are shipped from the additive manufacturer as a concentrate, containing one or more additives together, with a certain amount of base oil diluents. Accordingly, the weight amounts in the Table 1 below, as well as other amounts mentioned herein, are directed to the amount of active ingredient (that is the non-diluent portion of the ingredient). The weight percent (wt %) indicated below is based on the total weight of the lubricating oil composition.

TABLE 1

Typical Amounts of Other Lubricating Oil Components

| Compound | Approximate wt % (Useful) | Approximate wt % (Preferred) |
|---|---|---|
| Dispersant | 0.1-20 | 0.1-8 |
| Detergent | 0.1-20 | 0.1-8 |
| Friction Modifier | 0.01-5 | 0.01-1.5 |
| Antioxidant | 0.1-5 | 0.1-1.5 |
| Pour Point Depressant (PPD) | 0.0-5 | 0.01-1.5 |
| Anti-foam Agent | 0.001-3 | 0.001-0.15 |
| Viscosity Modifier (solid polymer basis) | 0.1-2 | 0.1-1 |
| Antiwear | 0.2-3 | 0.5-1 |
| Inhibitor and Antirust | 0.01-5 | 0.01-1.5 |

The foregoing additives are all commercially available materials. These additives may be added independently but are usually precombined in packages which can be obtained from suppliers of lubricant oil additives. Additive packages with a variety of ingredients, proportions and characteristics are available and selection of the appropriate package will take the requisite use of the ultimate composition into account.

The lube base stocks of the present disclosure are well suited as lube base stocks without blending limitations, and further, the lube base stock products are also compatible with lubricant additives for lubricant formulations. The lube base stocks of the present disclosure can optionally be blended with other lube base stocks to form lubricants. Useful cobase lube stocks include Group I, III, IV and V base stocks and gas-to-liquid (GTL) oils. One or more of the cobase stocks may be blended into a lubricant composition including the lube base stock at from 0.1 to 50 wt. %, or 0.5 to 40 wt. %, 1 to 35 wt. %, or 2 to 30 wt. %, or 5 to 25 wt. %, or 10 to 20 wt. %, based on the total lubricant composition.

The lube base stocks and lubricant compositions can be employed in the present disclosure in a variety of lubricant-related end uses, such as a lubricant oil or grease for a device or apparatus requiring lubrication of moving and/or interacting mechanical parts, components, or surfaces. Useful apparatuses include engines and machines. The lube base stocks of the present disclosure are most suitable for use in the formulation of automotive crank case lubricants, automotive gear oils, transmission oils, many industrial lubricants including circulation lubricant, industrial gear lubricants, grease, compressor oil, pump oils, refrigeration lubricants, hydraulic lubricants, metal working fluids.

Example 1—Feedstocks and DAOs

Table 2 shows properties of two types of vacuum resid feeds that are potentially suitable for deasphalting, referred to in this example as Resid A and Resid B. Both feeds have an API gravity of less than 6, a specific gravity of at least 1.0, elevated contents of sulfur, nitrogen, and metals, and elevated contents of carbon residue and n-heptane insolubles.

TABLE 2

Resid Feed Properties

| Resid (566° C.+) | Resid A | Resid B |
|---|---|---|
| API Gravity (degrees) | 5.4 | 4.4 |
| Specific Gravity (15° C.) (g/cc) | 1.0336 | 1.0412 |

TABLE 2-continued

| Resid Feed Properties | | |
|---|---|---|
| Resid (566° C.+) | Resid A | Resid B |
| Total Sulfur (wt %) | 4.56 | 5.03 |
| Nickel (wppm) | 43.7 | 48.7 |
| Vanadium (wppm) | 114 | 119 |
| TAN (mg KOH/g) | 0.314 | 0.174 |
| Total Nitrogen (wppm) | 4760 | 4370 |
| Basic Nitrogen (wppm) | 1210 | 1370 |
| Carbon Residue (wt %) | 24.4 | 25.8 |
| n-heptane insolubles (wt %) | 7.68 | 8.83 |
| Wax (Total—DSC) (wt %) | 1.4 | 1.32 |
| KV @ 100° C. (cSt) | 5920 | 11200 |
| KV @ 135° C. (cSt) | 619 | 988 |

The resids shown in Table 2 were used to form deasphalted oil. Resid A was exposed to propane deasphalting (deasphalted oil yield <40%) and pentane deasphalting conditions (deasphalted oil yield ~65%). Resid B was exposed to butane deasphalting conditions (deasphalted oil yield ~75%). Table 3 shows properties of the resulting deasphalted oils.

TABLE 3

| Examples of Deasphalted Oils | | | |
|---|---|---|---|
| | $C_3$ DAO | $C_4$ DAO | $C_5$ DAO |
| API Gravity (degrees) | 22.4 | 12.9 | 12.6 |
| Specific Gravity (15° C.) (g/cc) | 0.9138 | 0.9782 | 0.9808 |
| Total Sulfur (wt %) | 2.01 | 3.82 | 3.56 |
| Nickel (wppm) | <0.1 | 5.2 | 5.3 |
| Vanadium (wppm) | <0.1 | 15.6 | 17.4 |
| Total Nitrogen (wppm) | 504 | 2116 | 1933 |
| Basic Nitrogen (wppm) | 203 | <N/A> | 478 |
| Carbon Residue (wt %) | 1.6 | 8.3 | 11.0 |
| KV @ 100° C. (cSt) | 33.3 | 124 | 172 |
| VI | 96 | 61 | <N/A> |
| SimDist (ASTM D2887) ° C. | | | |
| 5 wt % | 509 | 490 | 527 |
| 10 wt % | 528 | 515 | 546 |
| 30 wt % | 566 | 568 | 588 |
| 50 wt % | 593 | 608 | 619 |
| 70 wt % | 623 | 657 | 664 |
| 90 wt % | 675 | <N/A> | <N/A> |
| 95 wt % | 701 | <N/A> | <N/A> |

As shown in Table 3, the higher severity deasphalting provided by propane deasphalting results in a different quality of deasphalted oil than the lower severity $C_4$ and $C_5$ deasphalting that was used in this example. It is noted that the $C_3$ DAO has a kinematic viscosity @100° C. of less than 35, while the $C_4$ DAO and $C_5$ DAO have kinematic viscosities greater than 100. The $C_3$ DAO also generally has properties more similar to a lubricant base stock product, such as a higher API gravity, a lower metals content/sulfur content/nitrogen content, lower CCR levels, and/or a higher viscosity index.

Example 2—Blocked Operation

A configuration similar to the configuration shown in FIGS. 3 to 5 was used to process a resid-type feed that substantially included 510° C.+ components. The configuration for this example did not include recycle products as part of the feed for the sour stage or for further sweet stage processing. The feed was initially deasphalted using n-pentane to produce 75 wt % deasphalted oil and 25 wt % deasphalter rock or residue. The resulting deasphalted oil had an API gravity of 12.3, a sulfur content of 3.46 wt %, and a nitrogen content of 2760 wppm. The deasphalted oil was then hydroprocessed in an initial sour hydroprocessing stage that included four catalyst beds. The first two catalyst beds corresponded to commercially available demetallization catalysts. The third catalyst bed corresponded to commercially available hydrotreating catalyst, including at least a portion of a commercially available bulk metal hydrotreating catalyst. The fourth catalyst bed included a commercially available hydrocracking catalyst. The effluent from each catalyst bed was cascaded to the next catalyst bed. The average reaction temperature across each catalyst bed was 378° C. for the first demetallization catalyst bed, 388° C. for the second demetallization catalyst bed, 389° C. for the hydrotreating catalyst bed, and 399° C. for the hydrocracking catalyst bed. The flow rate of the feed relative to the total volume of catalyst in the sour hydroprocessing stage was an LHSV of 0.16 $h^{-1}$. The hydrogen partial pressure was 2500 psia (17.2 MPa-a) and the hydrogen treat gas flow rate was 8000 scf/b (~1420 $Nm^3/m^3$). Under these conditions, the hydroprocessing consumed roughly 2300 scf/b (~400 $Nm^3/m^3$). The conditions resulted in roughly 50 wt % conversion relative to 370° C.

After processing in the initial sour stage, a fractionator was used to separate the hydroprocessed effluent into various fractions. The fractions included light ends, at least one fuels fraction, a light neutral fraction, a heavy neutral fraction, and a bright stock fraction. Table 4 shows additional details regarding the hydroprocessed effluent from the initial sour stage.

TABLE 4

| Hydroprocessed Effluent (Sour Stage) | | | |
|---|---|---|---|
| Product | Wt % (of total effluent) | Nitrogen content (wppm) | Solvent dewaxed VI |
| $H_2S$ | 3.7 | | |
| $NH_3$ | 0.3 | | |
| $C_1$ | 0.4 | | |
| $C_2$ | 0.4 | | |
| $C_3$ | 0.7 | | |
| $C_4$ | 0.9 | | |
| $C_5$ | 1.3 | | |
| $C_6$ to 370° C. (fuels fraction) | 45.6 | | |
| Light Neutral | 13.9 | 1-15 | 102.8 |
| Heavy Neutral | 14.0 | 1-15 | 99.8 |
| Bright stock | 22.2 | 1-15 | 110.5 |

The light neutral, heavy neutral, and bright stock fractions from the initial sour hydroprocessing stage were then further hydroprocessed in the presence of a noble metal hydrocracking catalyst and a noble metal dewaxing catalyst. The sweet stage conditions for each fraction were selected separately to achieve desired VI values.

For the light neutral feed, the sweet stage conditions were selected to achieve roughly 30 wt % conversion relative to 370° C. This produced a light neutral lubricant base stock in a 70.6 wt % yield relative to the light neutral feed. The resulting light neutral base stock had a VI of 109.9 and a kinematic viscosity at 100° C. of 5.8 cSt. For the heavy neutral feed, the sweet stage conditions were selected to achieve roughly 6 wt % conversion relative to 370° C. This produced a heavy neutral lubricant base stock in a 93.7 wt % yield relative to the heavy neutral feed. The resulting heavy neutral base stock had a VI of 106.6 and a kinematic viscosity at 100° C. of 11.7 cSt. For the bright stock feed, the sweet stage conditions were selected to achieve roughly 30 wt % conversion relative to 370° C. This produced a bright stock base stock in a 54.3 wt % yield relative to the bright stock feed. The resulting bright stock base stock had a VI of 103 and a kinematic viscosity at 100° C. of 32 cSt. Additionally, a yield of 16.1 wt % of a light neutral lubricant boiling range product was generated with a kinematic viscosity at 100° C. of 6 cSt and a viscosity index of roughly 100. This additional light neutral lubricant boiling range product was optionally suitable for recycle to either the light neutral or heavy neutral processing block. This could allow, for example, the light neutral or heavy neutral processing block to be operated at a reduced temperature (due to further reduced nitrogen in the combined feed). Such reduced temperature can be favorable for further reducing any additional aromatics that might be present in the recycled product. Alternatively, the additional light neutral product could be recycled to the initial sour stage for further upgrading, although this could lead to additional production of fuels as opposed to lubricant products.

Example 4—Adsorption of Polynuclear Aromatics (Prophetic)

A deasphalted oil is processed using a configuration similar to the configuration shown in FIG. 4, with block operation for the second (sweet) hydroprocessing stage. The deasphalted oil is generated by solvent deasphalting of a feedstock including a vacuum resid portion. The yield (weight) of deasphalted oil relative to the weight of vacuum resid in the feedstock is 50 wt %. After hydroprocessing in the first stage, separation to allow block operation, and hydroprocessing in the second stage, the resulting heavy neutral base stock product generated from the process has a Saybolt color of 14 or less.

The lubricant base stock is treated with adsorbents to remove polynuclear aromatics. The base stock corresponds to heavy neutral base stock with a kinematic viscosity at 100° C. of 10 cSt and a dynamic viscosity of 12 cP. The adsorbent corresponds to activated carbon In preparation for the run, the adsorbent is loaded into an autoclave basket and dried at 260° C. overnight. Prior to the run, the 300 mL autoclave shell is dried at 121° C. for 15 minutes, followed by addition of 100 mL of the colored base stock and the basket with adsorbent. The autoclave is purged several times with $N_2$, heated to 150° C., and stirred at 50 rpm. After temperature equilibration, the total system pressure is held at 100 psig $N_2$. Liquid samples are taken at 15, 30, 60, 90, 120, and 360 min after the start of the reaction. The autoclave is then cooled to room temperature and overhead gas pressure was released via opening of a valve. After cooling, the base stock and adsorbent are recovered. After exposure of the base stock to the adsorbent, the base stock has a Saybolt Color of 20 or more.

Example 5—Adsorption to Improve Heavy Neutral Base Stock Color

Samples of heavy neutral base stock made by catalytic processing of deasphalted oil were exposed to an adsorbent in an autoclave. The adsorbent corresponded to an activated carbon available from Calgon Carbon (CAL TR 12×40). The activated carbon had a mean particle diameter of 0.8-1.0 mm and a density of 0.54 g/ml. The activated carbon was sieved to 14/18 mesh prior to insertion into the autoclave. The base stock samples were characterized at various times during exposure to the adsorbent based on fluorescence and ultraviolet spectroscopy.

The heavy neutral base stock had the properties shown in Table 5. The base stock had a T10 of roughly 400° C. and a T90 greater than 500° C. Prior to exposure to the adsorbent, the heavy neutral base stock had a Saybolt color of less than 14.

TABLE 5

Feed for Characterization of Aromatic Adsorption

| Measurement | Value | Unit |
|---|---|---|
| Viscosity at 100° C. | 12.3 | cSt |
| Viscosity at 150° C. | 4.6 | cSt |
| Viscosity at 200° C. | 2.4 | cSt |
| Density at 15° C. | 0.8679 | g/mL |
| Density at 70° C. | 0.8341 | g/mL |
| Density at 200° C. | ~0.7607 | g/mL |
| Pour point | −24 | ° C. |
| Hydrogen | 13.85 | % |

In preparation for the run, the adsorbent was loaded into an autoclave basket and dried at 260° C. overnight. Prior to the run, the 300 mL autoclave shell was dried at 121° C. for 15 minutes, followed by addition of 100 mL of the colored base stock and the basket with adsorbent. The autoclave was purged several times with $N_2$, heated to 150° C., and stirred at roughly 10 rpm. After temperature equilibration, the total system pressure was held at 100 psig $N_2$. Liquid samples were taken at 15, 30, 60, 90, 120, and 360 min after the start of the reaction. The autoclave was then cooled to room temperature and overhead gas pressure was released via opening of a valve. After cooling the base stock and adsorbent were recovered.

Figure 6:
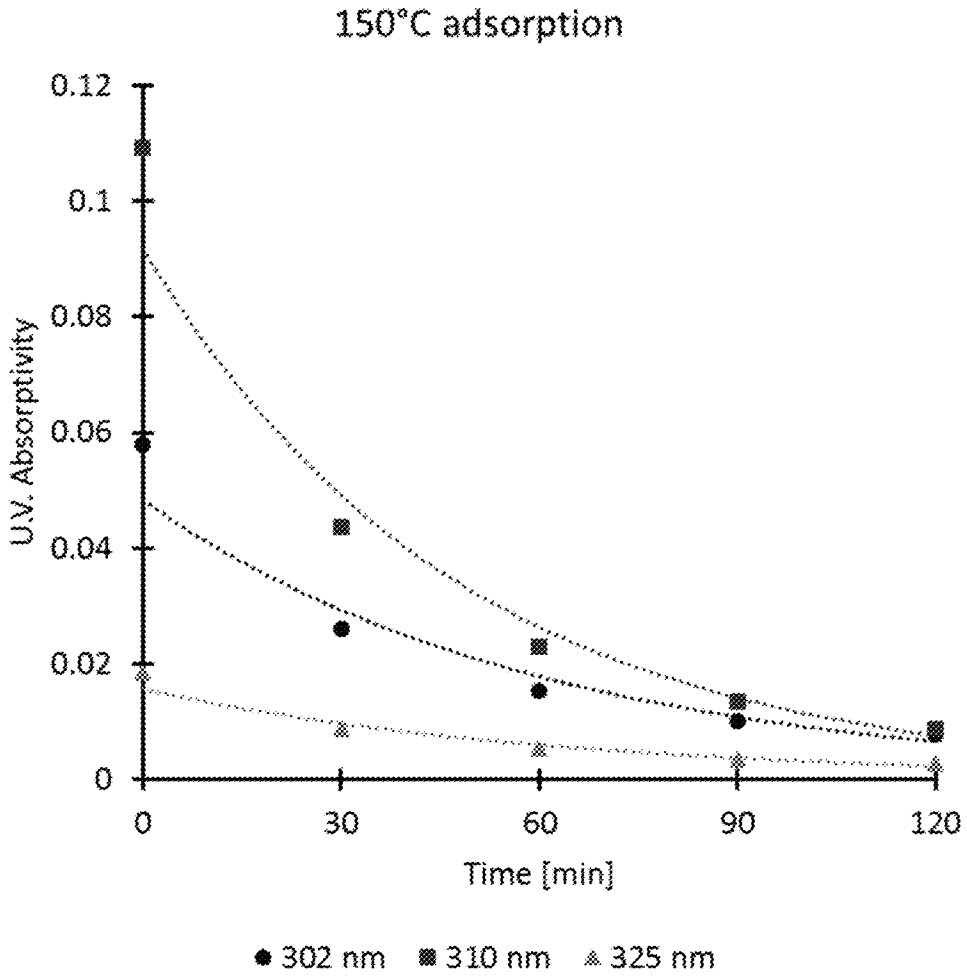
FIG. 6 shows UV absorption values for a heavy neutral base stock produced by exposure to an adsorbent at 150° C.
Figure 7:
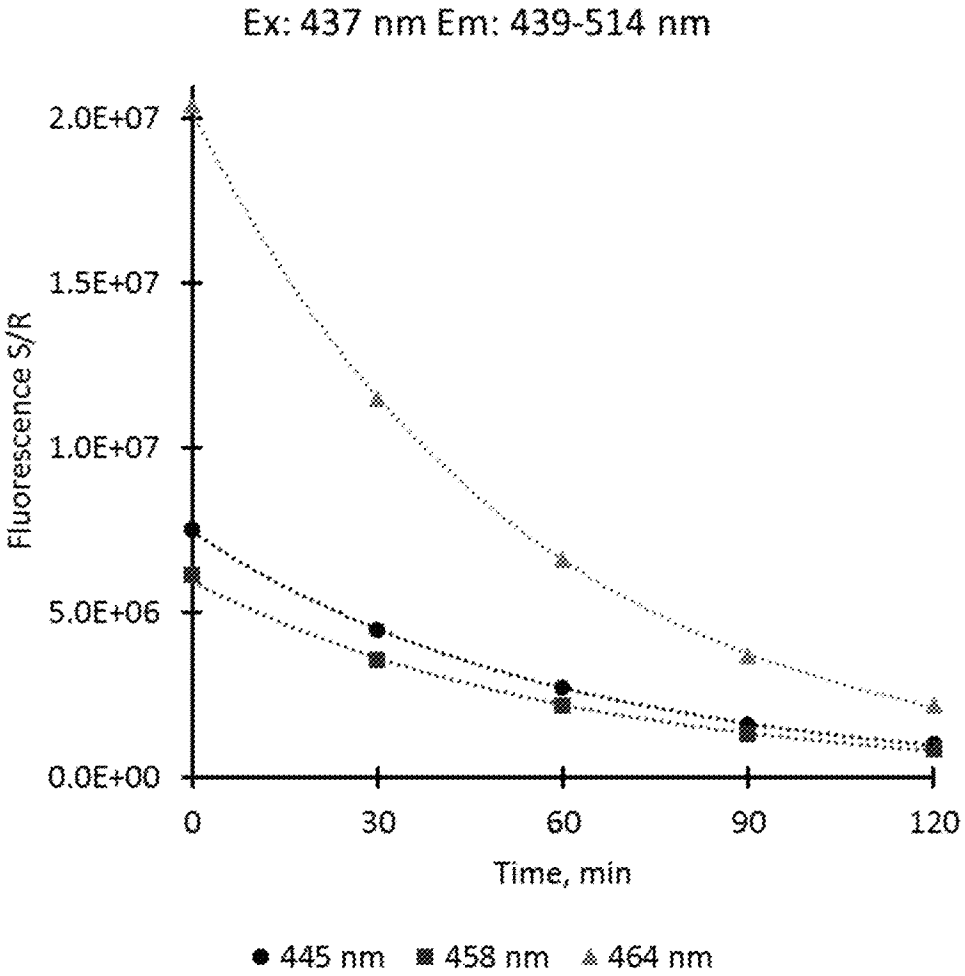
FIG. 7 shows fluorescence spectroscopy values for a heavy neutral base stock produced by exposure to an adsorbent at 150° C.

FIG. 6 and FIG. 7 show results from exposing the feed to the adsorbent at 150° C. for various periods of time. FIG. 6 shows UV adsorption values for the initial feed and the feed after exposure to the adsorbent. The data values plotted in FIG. 6 are also shown in Table 6.

TABLE 6

UV Adsorption Values in l/g * cm after Adsorption at 150° C.

| | 302 nm | 310 nm | 325 nm |
|---|---|---|---|
| Feed | 0.0578 | 0.1092 | 0.0184 |
| 30 min | 0.026 | 0.0436 | 0.0086 |
| 60 min | 0.0153 | 0.0229 | 0.0052 |
| 90 min | 0.0101 | 0.0133 | 0.0035 |
| 120 min | 0.0076 | 0.0087 | 0.0026 |

As shown in FIG. 6, increasing exposure to the adsorbent led to reductions in the amount of adsorption at UV wavelengths of 302 nm, 310 nm, and 325 nm. This reduced adsorption is believed to indicate a reduced presence of polynuclear aromatics within the sample. After 360 minutes of exposure, the color of the base stock had improved to a Saybolt color of 19.

FIG. 7 shows corresponding results from fluorescence spectroscopy on the samples from FIG. 6. For the results in FIG. 7 (also shown in Table 7), the excitation wavelength was 437 nm.

TABLE 7

| UV Fluorescence Values (Signal over Reference) after Adsorption at 150° C. | | | |
|---|---|---|---|
| | 445 nm | 458 nm | 464 nm |
| Feed | 7520614 | 6133896 | 20367382 |
| 30 min | 4499420 | 3592700 | 11494879 |
| 60 min | 2740949 | 2188356 | 6620721 |
| 90 min | 1602139 | 1309674 | 3700172 |
| 120 min | 1021406 | 860656 | 2184659 |

The fluorescence spectroscopy shows a similar decrease in fluorescence at wavelengths of 445 nm, 458 nm, and 464 nm when the excitation wavelength is less than 440 nm. The decreased fluorescence is believed to indicate a reduced presence of polynuclear aromatics in the sample.

Figure 8:
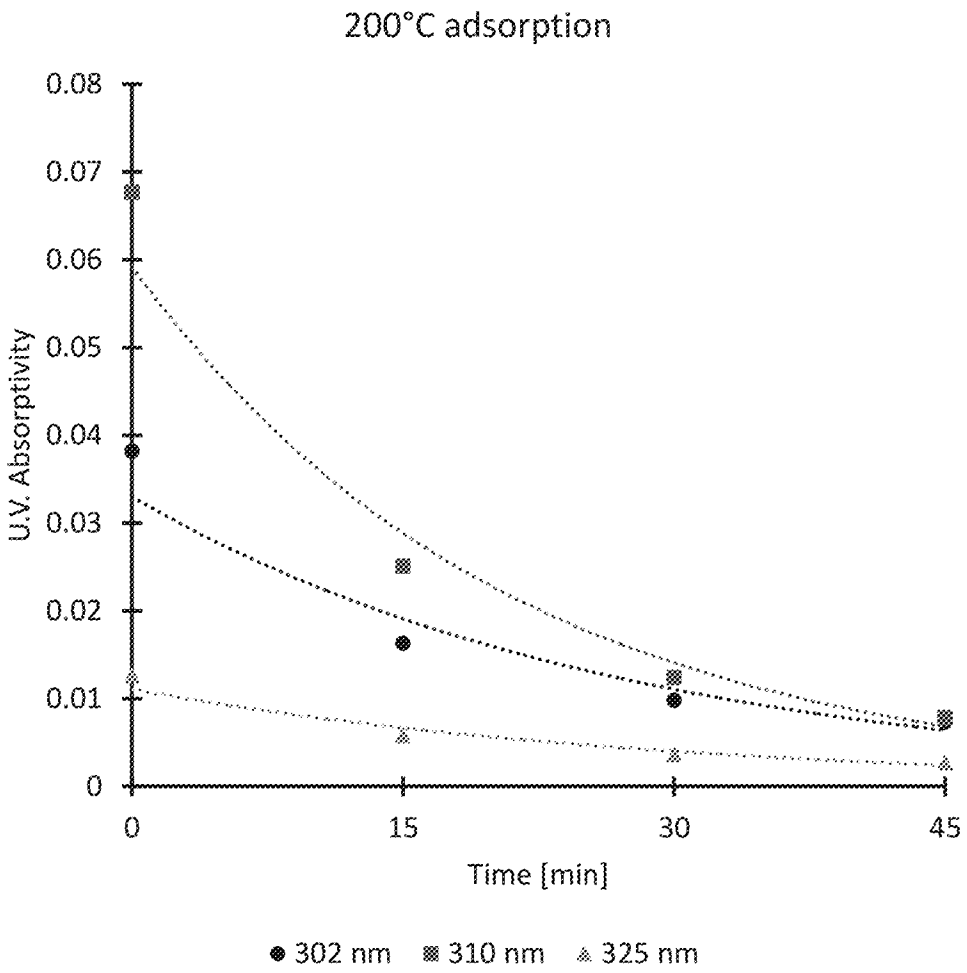
FIG. 8 shows UV absorption values for a heavy neutral base stock produced by exposure to an adsorbent at 200° C.
Figure 9:
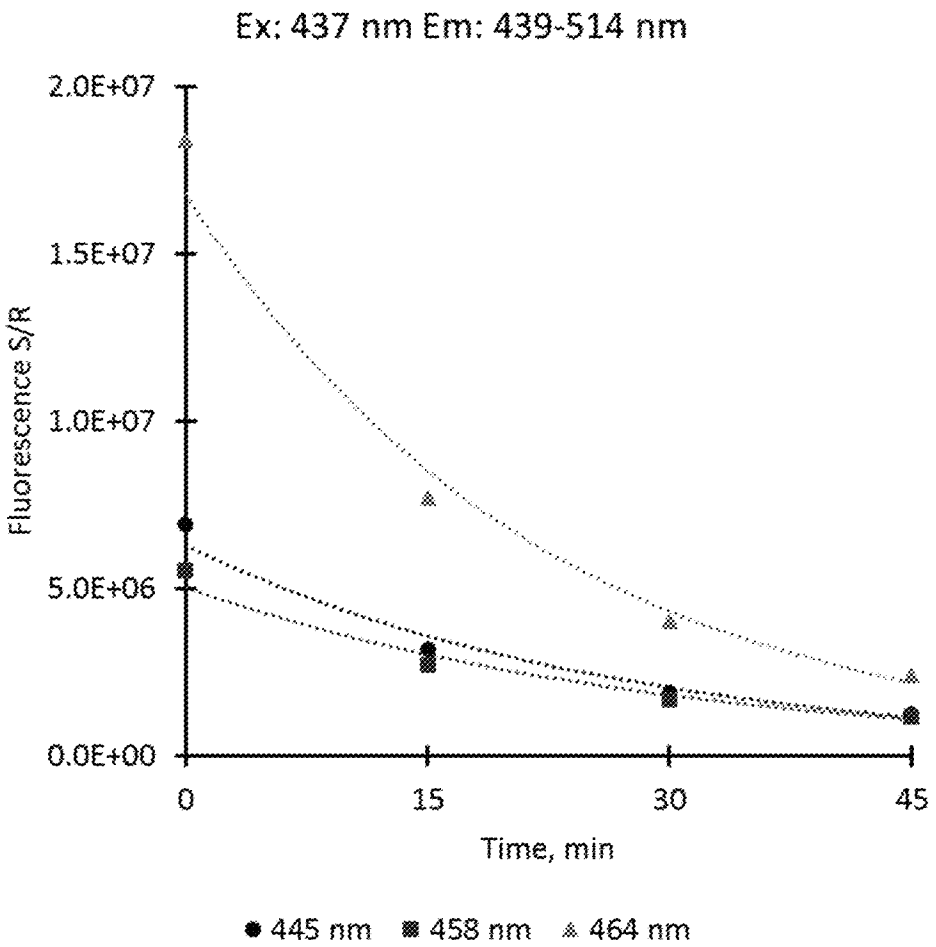
FIG. 9 shows fluorescence spectroscopy values for a heavy neutral base stock produced by exposure to an adsorbent at 200° C.

FIGS. 8 and 9 show similar results for exposing the heavy neutral base stock to the adsorbent at a temperature of 200° C. In FIG. 8 (corresponding data values also shown in Table 8), exposure to the adsorbent at 200° C. also resulted in reduced UV adsorption values at the wavelengths shown in Table 8.

TABLE 8

| UV Adsorption Values in l/g * cm after Adsorption at 200° C. | | | |
|---|---|---|---|
| | 302 nm | 310 nm | 325 nm |
| 0 min | 0.0382 | 0.0677 | 0.0126 |
| 15 min | 0.0163 | 0.0251 | 0.0058 |
| 30 min | 0.0098 | 0.0124 | 0.0036 |
| 45 min | 0.0073 | 0.0078 | 0.0027 |

It is noted that the scale of the graph in FIG. 8 is larger than the scale in FIG. 6. After 360 minutes, the Saybolt color of the sample was roughly 15. Thus, it is believed that the reduced UV absorption values in Table 8 again show that improved Saybolt color can be correlated with reduced contents of aromatics.

FIG. 9 similarly again indicated that sufficient aromatic adsorption had taken place to provide a reduction in aromatics, with a corresponding increase in Saybolt color. Table 9 shows the data values corresponding to FIG. 9.

TABLE 9

| UV Fluorescence Values (Signal over Reference) after Adsorption at 200° C. | | | |
|---|---|---|---|
| | 445 nm | 458 nm | 464 nm |
| 0 min | 6948161 | 5562288 | 18395649 |
| 15 min | 3221004 | 2720449 | 7708796 |
| 30 min | 1914383 | 1707778 | 4027827 |
| 45 min | 1278837 | 1202113 | 2399204 |

Additional Embodiments

Embodiment 1

A method for making lubricant base stock, comprising: performing solvent deasphalting under effective solvent deasphalting conditions on a feedstock having a T5 boiling point of 370° C. or more and a T50 of 510° C. or more, the effective solvent deasphalting conditions producing a yield of deasphalted oil of 40 wt % or more of the feedstock (or 50 wt % or more), the solvent deasphalting optionally being performed using a $C_{4+}$ solvent; hydroprocessing at least a portion of the deasphalted oil under first effective hydroprocessing conditions to form a hydroprocessed effluent, the at least a portion of the deasphalted oil having an aromatics content of 60 wt % or more, the hydroprocessed effluent comprising a sulfur content of 300 wppm or less, a nitrogen content of 100 wppm or less, or a combination thereof; separating, from the hydroprocessed effluent, at least a fuels boiling range fraction, a first fraction comprising polynuclear aromatics and having a $T_5$ distillation point of at least 370° C., and a second fraction having a $T_5$ distillation point of at least 370° C., the second fraction having a higher kinematic viscosity at 100° C. than the first fraction; hydroprocessing i) at least a portion of the first fraction under second effective hydroprocessing conditions and/or ii) at least a portion of the second fraction under second effective hydroprocessing conditions, the second effective hydroprocessing conditions comprising catalytic dewaxing conditions, to form a twice-hydroprocessed effluent comprising a 370° C.+ portion having a first kinematic viscosity at 100° C.; and i) exposing the at least a portion of the first fraction, prior to the hydroprocessing under second effective hydroprocessing conditions, to an adsorbent under aromatic adsorbent conditions to form an adsorbent effluent having a reduced content of polynuclear aromatics relative to the at least a portion of the first fraction prior to the exposing; ii) exposing at least a portion of the twice-hydroprocessed effluent, during or after the hydroprocessing under second effective hydroprocessing conditions, to an adsorbent under aromatic adsorbent conditions to form an adsorbent effluent having a reduced content of polynuclear aromatics relative to the at least a portion of the twice-hydroprocessed effluent prior to the exposing; or iii) a combination of i) and ii).

Embodiment 2

The method of Embodiment 1, wherein the at least a portion of the first fraction is hydroprocessed under the second effective hydroprocessing conditions, and i) after the exposing, the at least a portion of the twice-hydroprocessed effluent (or the at least a portion of the first fraction) has a Saybolt color this is greater than the Saybolt color of the at least a portion of the twice-hydroprocessed effluent (or the at least a portion of the first fraction) by two or more (or four or more); or ii) after the exposing and the hydroprocessing under second effective hydroprocessing conditions, the at least a portion of the twice-hydroprocessed effluent has a Saybolt color of 15 or more (or 18 or more, or 20 or more); or iii) after the hydroprocessing under second effective hydroprocessing conditions and prior to the exposing, the at least a portion of the twice-hydroprocessed effluent has a Saybolt color of 14 or less (or 16 or less); or iv) a combination of two or more of i), ii) and iii).

Embodiment 3

The method of Embodiment 1, wherein the at least a portion of the first fraction is hydroprocessed under the second effective hydroprocessing conditions, and prior to the exposing, the at least a portion of the twice-hydroprocessed effluent has a turbidity of 2 NTU or more.

Embodiment 4

The method of any of the above embodiments, wherein the second effective hydroprocessing conditions further comprise hydrotreating conditions, hydrocracking conditions, and aromatic saturation conditions, and wherein the exposing at least a portion of the twice-hydroprocessed effluent to an adsorbent under aromatic adsorbent conditions during the hydroprocessing under second effective hydroprocessing conditions comprises performing the exposing a) after the hydrotreating and prior to the hydrocracking; b) after the hydrocracking and prior to the catalytic dewaxing; or c) after the catalytic dewaxing and prior to the aromatic saturation.

Embodiment 5

The method of any of the above embodiments, further comprising separating a third fraction and a fourth fraction from the twice-hydroprocessed effluent, the fourth fraction having a higher kinematic viscosity at 100° C. than the third fraction, the fourth fraction comprising the at least a portion of the twice-hydroprocessed effluent.

Embodiment 6

The method of any of Embodiments 1-4, further comprising separating a third fraction and a fourth fraction from the at least a portion of the twice-hydroprocessed effluent, the fourth fraction having a higher kinematic viscosity at 100° C. than the third fraction; and adding a diluent stream to the twice-hydroprocessed effluent or the at least a portion of the twice-hydroprocessed effluent prior to separating the third fraction and the fourth fraction, the diluent stream optionally comprising at least a portion of fuels boiling range fraction, at least a portion of the third fraction, or a combination thereof.

Embodiment 7

The method of any of the above embodiments, further comprising hydroprocessing at least a portion of the second fraction under third effective hydroprocessing conditions, the third effective hydroprocessing conditions comprising catalytic dewaxing conditions, to form a second twice-hydroprocessed effluent comprising a 370° C.+ portion having a second kinematic viscosity at 100° C.; separating from at least a portion of the second twice-hydprocessed effluent a fifth fraction and a sixth fraction, the sixth fraction having a higher kinematic viscosity at 100° C. than the fifth fraction; and exposing, at least a portion of the fifth fraction to an adsorbent under aromatic adsorbent conditions to form an effluent having a reduced content of polynuclear aromatics relative to the at least a portion of the fifth fraction.

Embodiment 8

The method of any of the above embodiments, wherein i) the exposing the at least a portion of the first fraction, ii) the exposing at least a portion of the twice-hydroprocessed effluent, or iii) a combination of i) and ii) to an adsorbent under aromatic adsorbent conditions comprises exposing the at least a portion of the twice-hydroprocessed effluent to an adsorbent comprising one or more of activated carbon, hydroxyl-modified activated carbon, attapulgus clay, an adsorbent clay, silica or alumina with greater than 10 $m^2/g$ BET surface area, porous polymer, porous resin, diatomaceous earth, and zeolite.

Embodiment 9

The method of embodiment 1, wherein a) the at least a portion of the twice-hydroprocessed effluent comprises a viscosity of 10 cP to 13 cP at 150° C. and the aromatic adsorbent conditions comprise an exposure temperature of 120° C. to 160° C.; b) the at least a portion of the twice-hydroprocessed effluent comprises a viscosity of 13 cP to 15 cP at 150° C. and the aromatic adsorbent conditions comprise an exposure temperature of 160° C. to 200° C.; or c) the at least a portion of the twice-hydroprocessed effluent comprises a viscosity of 8 cP to 10 cP at 150° C. and the aromatic adsorbent conditions comprise an exposure temperature of 80° C. to 120° C.

Embodiment 10

The method of any of the above embodiments, wherein the yield of deasphalted oil is 65 wt % or less, or wherein the deasphalted oil has an aromatics content of 70 wt % or more, or a combination thereof.

Embodiment 11

The method of any of the above embodiments, wherein the $C_{4+}$ solvent comprises a $C_{5+}$ solvent, a mixture of two or more $C_5$ isomers, or a combination thereof.

Embodiment 12

The method of any of the above embodiments, wherein the first effective hydroprocessing conditions comprise ebullated bed processing conditions, slurry hydroprocessing conditions, or a combination thereof; or wherein the first hydroprocessing conditions further comprise first aromatic saturation conditions, the first aromatic saturation conditions comprising exposing the at least a portion of the deasphalted oil to a hydrocracking catalyst and a demetallization catalyst, the at least a portion of the deasphalted oil being exposed to the demetallization catalyst after exposing the at least a portion of the deasphalted oil to the hydrocracking catalyst; or a combination thereof.

Embodiment 13

The method of any of the above embodiments, wherein separating the hydroprocessed effluent further comprises forming an additional fraction having a $T_5$ distillation point of at least 370° C., the method further comprising: hydroprocessing at least a portion of the additional fraction under third effective hydroprocessing conditions, the third effective hydroprocessing conditions comprising catalytic dewaxing conditions, to form a third catalytically dewaxed effluent comprising a 370° C.+ portion having a kinematic viscosity at 100° C. of 3.5 cSt or more.

Embodiment 14

The method of any of the above embodiments, wherein a ratio of non-aromatic carbon to aromatic carbon in aromatics in the at least a portion of the twice-hydroprocessed effluent is 1:4 or less; or wherein a ratio of non-aromatic carbon to aromatic carbon in polynuclear aromatics in the at least a portion of the twice-hydroprocessed effluent is 1:6 or less; or a combination thereof.

Embodiment 15

The method of any of the above embodiments, wherein the adsorbent effluent has a reduced content of polynuclear aromatics comprising four or more rings (or six or more rings) relative to the at least a portion of the twice-hydroprocessed effluent.

Additional Embodiment A

The method of any of the above embodiments, further comprising adding a diluent to the first fraction, adding a diluent to the at least a portion of the first fraction, adding a diluent to the second fraction, adding a diluent to the at least a portion of the second fraction, or a combination thereof.

Additional Embodiment B

A method for making lubricant base stock, comprising: performing solvent deasphalting under effective solvent deasphalting conditions on a feedstock having a T5 boiling point of 370° C. or more and a T50 of 510° C. or more, the effective solvent deasphalting conditions producing a yield of deasphalted oil of 40 wt % or more of the feedstock; hydroprocessing at least a portion of the deasphalted oil, under hydroprocessing conditions comprising an average hydroprocessing temperature of 400° C. or more and a LHSV of 1.0 $hr^{-1}$ or less (or 0.5 $hr^{-1}$ or less), to form a hydroprocessed effluent, the at least a portion of the deasphalted oil comprising a sulfur content of 1000 wppm or more and an aromatics content of 60 wt % or more (or 70 wt % or more), the hydroprocessed effluent comprising a sulfur content of 300 wppm or less; and exposing at least a portion of the hydroprocessed effluent to an adsorbent under aromatic adsorbent conditions to form an adsorbent effluent having a reduced content of polynuclear aromatics relative to the at least a portion of the hydroprocessed effluent prior to the exposing, the hydroprocessing conditions optionally comprising hydrotreating conditions, hydrocracking conditions, or a combination thereof; the at least a portion of the deasphalted oil optionally comprising 1000 wppm or more of sulfur.

Additional Embodiment C

A lubricant boiling range composition comprising a T5 boiling point of 370° C. or more, a T50 of 510° C. or more, a viscosity index of 80 or more (or 90 to 120), a kinematic viscosity at 100° C. of 6.0 cSt to 16 cSt, a pour point of −15° C. or less, and a polynuclear aromatics content of 0.01 wppm to 100 wppm (or 1.0 wppm to 100 wppm, or 0.1 wppm to 10 wppm).

When numerical lower limits and numerical upper limits are listed herein, ranges from any lower limit to any upper limit are contemplated. While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which the invention pertains.

The present invention has been described above with reference to numerous embodiments and specific examples. Many variations will suggest themselves to those skilled in this art in light of the above detailed description. All such obvious variations are within the full intended scope of the appended claims.

The invention claimed is:

1. A method for making lubricant base stock, comprising:

performing solvent deasphalting, under effective solvent deasphalting conditions on a feedstock having a T5 boiling point of 370° C. or more and a T50 of 510° C. or more, the effective solvent deasphalting conditions producing a yield of deasphalted oil of 40 wt % or more of the feedstock;

hydroprocessing at least a portion of the deasphalted oil under first effective hydroprocessing conditions to form a hydroprocessed effluent, the at least a portion of the deasphalted oil having an aromatics content of 60 wt % or more, the hydroprocessed effluent comprising a sulfur content of 300 wppm or less, a nitrogen content of 100 wppm or less, or a combination thereof;

separating, from the hydroprocessed effluent, at least a fuels boiling range fraction, a first fraction comprising polynuclear aromatics and having a T5 distillation point of at least 370° C., and a second fraction having T5 distillation point of at least 370° C., the second fraction having a higher kinematic viscosity at 100° C. than the first fraction;

hydroprocessing at least a portion of the first fraction under second effective hydroprocessing conditions, the second effective hydroprocessing conditions comprising catalytic dewaxing conditions, to form a twice-hydroprocessed effluent comprising a 370° C.+ portion having a first kinematic viscosity at 100° C.; and i) exposing the at least a portion of the first fraction, prior to the hydroprocessing under second effective hydroprocessing conditions, to an adsorbent under aromatic adsorbent conditions to form an adsorbent effluent having a reduced content of polynuclear aromatics relative to the at least a portion of the first fraction prior to the exposing; ii) exposing at least a portion of the twice-hydroprocessed effluent, during or after the hydroprocessing under second effective hydroprocessing conditions, to an adsorbent under aromatic adsorbent conditions to form an adsorbent effluent having a reduced content of polynuclear aromatics relative to the at least a portion of the twice-hydroprocessed effluent prior to the exposing; or iii) a combination of i) and ii); and further comprising separating a third fraction and a fourth fraction from the at least a portion of the twice-hydroprocessed effluent, the fourth fraction having a higher kinematic viscosity at 100° C. than the third fraction and adding a diluent stream to the twice-hydroprocessed effluent or the at least a portion of the twice-hydroprocessed effluent prior to separating the third fraction and the fourth fraction.

2. The method of claim 1, wherein after the exposing, the at least a portion of the twice-hydroprocessed effluent has a Saybolt color that is greater than the Saybolt color of the at least a portion of the twice-hydroprocessed effluent prior to the exposing by 2 or more; or wherein after the exposing, the at least a portion of the first fraction has a Saybolt color that is greater than the Saybolt color of the at least a portion of the first fraction prior to the exposing by 2 or more; or a combination thereof.

3. The method of claim 1, wherein the at least a portion of the twice-hydroprocessed effluent is exposed to the adsorbent after the hydroprocessing under second effective hydroprocessing conditions, and wherein the at least a portion of the twice-hydroprocessed effluent has a Saybolt color of 16 or less after the hydroprocessing under second effective hydroprocessing conditions and prior to the exposing.

4. The method of claim 1, wherein performing solvent deasphalting comprises performing solvent deasphalting using a $C_{4+}$ solvent.

5. The method of claim 1, wherein the second effective hydroprocessing conditions further comprise hydrotreating conditions, hydrocracking conditions, and aromatic saturation conditions.

6. The method of claim 1, wherein the diluent stream comprises at least a portion of the fuels boiling range fraction, at least a portion of the third fraction, or a combination thereof.

7. The method of claim 1, further comprising adding a diluent stream to the first fraction, or adding a diluent stream to the at least a portion of the first fraction prior to the exposing, or a combination thereof.

8. The method of claim 1, wherein i) the exposing the at least a portion of the first fraction, ii) the exposing at least a portion of the twice-hydroprocessed effluent, or iii) a combination of i) and ii) to an adsorbent under aromatic adsorbent conditions comprises exposing to an adsorbent comprising one or more of activated carbon, hydroxyl-modified activated carbon, attapulgus clay, an adsorbent clay, silica or alumina with greater than 10 $m^2/g$ BET surface area, porous polymer, porous resin, diatomaceous earth, and zeolite.

9. The method of claim 1, wherein a) the at least a portion of the twice-hydroprocessed effluent comprises a viscosity of 10 cP to 13 cP at 150° C. and the aromatic adsorbent conditions comprise an exposure temperature of 120° C. to 160° C.;

b) the at least a portion of the twice-hydroprocessed effluent comprises a viscosity of 13 cP to 15 cP at 150° C. and the aromatic adsorbent conditions comprise an exposure temperature of 160° C. to 200° C.; or c) the at least a portion of the twice-hydroprocessed effluent comprises a viscosity of 8 cP to 10 cP at 150° C. and the aromatic adsorbent conditions comprise an exposure temperature of 80° C. to 120° C.

10. The method of claim 1, wherein the first effective hydroprocessing conditions comprise ebullated bed processing conditions, slurry hydroprocessing conditions, or a combination thereof.

11. The method of claim 1, wherein the first hydroprocessing conditions further comprise first aromatic saturation conditions, the first aromatic saturation conditions comprising exposing the at least a portion of the deasphalted oil to a hydrocracking catalyst and a demetallization catalyst, the at least a portion of the deasphalted oil being exposed to the demetallization catalyst after exposing the at least a portion of the deasphalted oil to the hydrocracking catalyst.

12. The method of claim 1, wherein the adsorbent effluent has a reduced content of polynuclear aromatics comprising six or more rings relative to the at least a portion of the twice-hydroprocessed effluent prior to the exposing.

13. The method of claim 1, i) wherein after the exposing and the hydroprocessing under second effective hydroprocessing conditions, the at least a portion of the twice-hydroprocessed effluent has a Saybolt color of 15 or more, or ii) wherein after the hydroprocessing under second effective hydroprocessing conditions and prior to the exposing, the at least a portion of the twice-hydroprocessed effluent has a Saybolt color of 14 or less, or iii) a combination of i) and ii).

14. A method for making lubricant base stock, comprising:

performing solvent deasphalting, under effective solvent deasphalting conditions on a feedstock having a T5 boiling point of 370° C. or more and a T50 of 510° C. or more, the effective solvent deasphalting conditions producing a yield of deasphalted oil of 40 wt % or more of the feedstock;

hydroprocessing at least a portion of the deasphalted oil under first effective hydroprocessing conditions to form a hydroprocessed effluent, the at least a portion of the deasphalted oil having an aromatics content of 60 wt % or more, the hydroprocessed effluent comprising a sulfur content of 300 wppm or less, a nitrogen content of 100 wppm or less, or a combination thereof;

separating, from the hydroprocessed effluent, at least a fuels boiling range fraction, a first fraction comprising polynuclear aromatics and having a T5 distillation point of at least 370° C., and a second fraction having a T5 distillation point of at least 370° C., the second fraction having a higher kinematic viscosity at 100° C. than the first fraction;

hydroprocessing at least a portion of the first fraction under second effective hydroprocessing conditions, the second effective hydroprocessing conditions comprising catalytic dewaxing conditions, to form a twice-hydroprocessed effluent comprising a 370° C.+ portion having a first kinematic viscosity at 100° C.; and i) exposing the at least a portion of the first fraction, prior to the hydroprocessing under second effective hydroprocessing conditions, to an adsorbent under aromatic adsorbent conditions to form an adsorbent effluent having a reduced content of polynuclear aromatics relative to the at least a portion of the first fraction prior to the exposing, ii) exposing at least a portion of the twice-hydroprocessed effluent, during or after the hydroprocessing under second effective hydroprocessing conditions, to an adsorbent under aromatic adsorbent conditions to form an adsorbent effluent having a reduced content of polynuclear aromatics relative to the at least a portion of the twice-hydroprocessed effluent prior to the exposing; or iii) a combination of i) and ii); and further comprising hydroprocessing at least a portion of the second fraction under third effective hydroprocessing conditions, the third effective hydroprocessing conditions comprising catalytic dewaxing conditions, to form a second twice-hydroprocessed effluent comprising a 370° C.+ portion having a second kinematic viscosity at 100° C.;

separating from at least a portion of the second twice-hydroprocessed effluent a fifth fraction and a sixth fraction, the sixth fraction having a higher kinematic viscosity at 100° C. than the fifth fraction; and exposing; at least a portion of the fifth fraction to an adsorbent under aromatic adsorbent conditions to form an effluent having a reduced content of polynuclear aromatics relative to the at least a portion of the fifth fraction.

15. A method for making lubricant base stock, comprising: performing solvent deasphalting, under effective solvent deasphalting conditions on a feedstock having a T5 boiling point of 370° C. or more and a T50 of 510° C. or more, the effective solvent deasphalting conditions producing a yield of deasphalted oil of 40 wt % or more of the feedstock;

hydroprocessing at least a portion of the deasphalted oil under first effective hydroprocessing conditions to form a hydroprocessed effluent, the at least a portion of the deasphalted oil having an aromatics content of 60 wt % or more, the hydroprocessed effluent comprising a sulfur content of 300 wppm or less, a nitrogen content of 100 wppm or less, or a combination thereof;

separating, from the hydroprocessed effluent, at least a fuels boiling range fraction, a first fraction comprising polynuclear aromatics and having a T5 distillation point of at least 370° C., and a second fraction having a T5 distillation point of at least 370° C., the second fraction having a higher kinematic viscosity at 100° C. than the first fraction;

hydroprocessing at least a portion of the first fraction under second effective hydroprocessing conditions, the second effective hydroprocessing conditions comprising catalytic dewaxing conditions, to form a twice-hydroprocessed effluent comprising a 370° C.+ portion having a first kinematic viscosity at 100° C.; and i) exposing the at least a portion of the first fraction, prior to the hydroprocessing under second effective hydroprocessing conditions to an adsorbent under aromatic adsorbent conditions to form an adsorbent effluent having a reduced content of polynuclear aromatics relative to the at least a portion of the first fraction prior to the exposing; ii) exposing at least a portion of the twice-hydroprocessed effluent, during or after the hydroprocessing under second effective hydroprocessing conditions, to an adsorbent under aromatic adsorbent conditions to form an adsorbent effluent having a reduced content of polynuclear aromatics relative to the at least a portion of the twice-hydroprocessed effluent prior to the exposing; or iii) a combination of i) and ii); and wherein separating the hydroprocessed effluent further comprises forming an additional fraction having a T5 distillation point of at least 370° C., the method further comprising:

hydroprocessing at least a portion of the additional fraction under third effective hydroprocessing conditions, the third effective hydroprocessing conditions comprising catalytic dewaxing conditions, to form a third catalytically dewaxed effluent comprising a 370° C.+ portion having a kinematic viscosity at 100° C. of 3.5 cSt or more.

16. A method for making lubricant base stock, comprising:

performing solvent deasphalting, under effective solvent deasphalting conditions on a feedstock having a T5 boiling point of 370° C. or more and a T50 of 510° C. or more, the effective solvent deasphalting conditions producing a yield of deasphalted oil of 40 wt % or more of the feedstock;

hydroprocessing at least a portion of the deasphalted oil under first effective hydroprocessing conditions to form a hydroprocessed effluent, the at least a portion of the deasphalted oil having an aromatics content of 60 wt % or more, the hydroprocessed effluent comprising a sulfur content of 300 wppm or less, a nitrogen content of 100 wppm or less, or a combination thereof;

separating, from the hydroprocessed effluent, at least a fuels boiling range fraction, a first fraction comprising 6+ ring aromatics and having a T5-distillation point of at least 370° C., and a second fraction having a T5-distillation point of at least 370° C., the second fraction having a higher kinematic viscosity at 100° C. than the first fraction;

hydroprocessing at least a portion of the second fraction under second effective hydroprocessing conditions, the second effective hydroprocessing conditions comprising catalytic dewaxing conditions, to form a twice-hydroprocessed effluent comprising a 370° C.+ portion having a kinematic viscosity at 100° C. of 16 cSt or greater; and i) exposing the at least a portion of the second fraction, prior to the hydroprocessing under second effective hydroprocessing conditions, to an adsorbent under aromatic adsorbent conditions to form an adsorbent effluent having a reduced content of polynuclear aromatics relative to the at least a portion of the second fraction prior to the exposing; ii) exposing at least a portion of the twice-hydroprocessed effluent, during or after the hydroprocessing under second effective hydroprocessing conditions, to an adsorbent under aromatic adsorbent conditions to form an adsorbent effluent having a reduced content of polynuclear aromatics relative to the at least a portion of the twice-hydroprocessed effluent prior to the exposing; or iii) a combination of i) and ii); and further comprising adding a diluent stream to the at least a portion of the twice-hydroprocessed effluent prior to the exposing at least a portion of the twice-hydroprocessed effluent to an adsorbent, the diluent stream comprising at least a portion of the fuels boiling range fraction, at least a portion of the first fraction, or a combination thereof.

17. The method of claim 16, wherein prior to the exposing, the at least a portion of the twice-hydroprocessed effluent has a turbidity of 2 NTU or more.

18. The method of claim 16, wherein the adsorbent effluent has a reduced content of polynuclear aromatics comprising six or more rings relative to the at least a portion of the twice-hydroprocessed effluent prior to the exposing.

* * * * *